US012030610B2

(12) United States Patent
Ripoll

(10) Patent No.: US 12,030,610 B2
(45) Date of Patent: Jul. 9, 2024

(54) SELF-CONTAINED AIR CONDITIONING UNIT WITH SWIVEL GYRO-MOUNT

(71) Applicant: Javier Ripoll, Doral, FL (US)

(72) Inventor: Javier Ripoll, Doral, FL (US)

( * ) Notice: Subject to any disclaimer, the term of this patent is extended or adjusted under 35 U.S.C. 154(b) by 0 days.

(21) Appl. No.: 18/210,861

(22) Filed: Jun. 16, 2023

(65) Prior Publication Data

US 2023/0356824 A1 Nov. 9, 2023

Related U.S. Application Data

(63) Continuation-in-part of application No. 17/175,052, filed on Feb. 12, 2021, now Pat. No. 11,932,372.
(Continued)

(51) Int. Cl.
*B63J 2/02* (2006.01)
*F24F 13/02* (2006.01)
(Continued)

(52) U.S. Cl.
CPC ..... *B63J 2/02* (2013.01); *F24F 13/0254* (2013.01); *F24F 13/222* (2013.01); *F24F 13/32* (2013.01); *F24F 2013/242* (2013.01)

(58) Field of Classification Search
CPC ... B60H 1/3226; B63J 2/00; B63J 2/02; B63J 2/04; B63J 2/12; F24F 13/0254;
(Continued)

(56) References Cited

U.S. PATENT DOCUMENTS 3,102,397 A * 9/1963 Trucchi ..... F24F 1/54 62/263
3,159,984 A * 12/1964 Eberhart ..... F24F 13/224 62/279
(Continued)

FOREIGN PATENT DOCUMENTS

EP 1955946 A2 * 8/2008 ..... B63J 2/04
EP 2587172 A1 * 5/2013 ..... F24F 1/0007
(Continued)

OTHER PUBLICATIONS

KR 100749019 B1 English Machine Translation (Year: 2007).*

*Primary Examiner* — Jenna M Maroney
(74) *Attorney, Agent, or Firm* — Melvin K. Silverman

(57) ABSTRACT

A swivel gyro-mount system for a self-contained air conditioning system, disclosing a unit having a main body with an evaporator having an evaporator cover with an aperture bordered on a side opposite of the evaporator by a plurality of frustum-spherical wall sections, thereby creating a boundary. A frustum-spherical gyro-swivel ring is positioned within the boundary of the frustum-spherical wall sections. A fitment ring is removably affixed to a protruding lip of the frustum-spherical gyro-swivel ring. The frustum-spherical wall sections movably contain the frustum-spherical gyro-swivel ring in a tight periphery, thereby allowing the frustum-spherical gyro-swivel ring to adjust in orientation, whereby the adjustment in orientation influences a direction of airflow in a conical range of orientations to a blower, whereby said blower may expel air in a plurality of selectable directions in a range of angulation resembling a dual conical shape.

23 Claims, 23 Drawing Sheets

Related U.S. Application Data

(60) Provisional application No. 63/436,044, filed on Dec. 29, 2022.

(51) Int. Cl.
*F24F 13/22* (2006.01)
*F24F 13/24* (2006.01)
*F24F 13/32* (2006.01)

(58) Field of Classification Search
CPC .... F24F 13/222; F24F 13/32; F24F 2013/242; F24F 2013/205
See application file for complete search history.

(56) References Cited

U.S. PATENT DOCUMENTS 3,364,989 A * 1/1968 Marsteller ..... F24F 1/032 62/262
3,888,090 A * 6/1975 Meyer ..... F24F 13/224 62/426
4,930,815 A * 6/1990 Tuggler, Jr. ..... F16L 59/163 285/142.1
4,977,750 A * 12/1990 Metcalfe ..... F24F 1/027 62/298
5,848,536 A * 12/1998 Dodge ..... B63J 2/04 62/286
6,088,959 A * 7/2000 Wait ..... E01C 13/083 47/2
6,101,829 A * 8/2000 Robinson ..... F24F 13/20 62/298
6,263,689 B1 * 7/2001 Dodge ..... B63J 2/04 62/240
7,278,272 B2 * 10/2007 Huston ..... B63J 2/04 62/240
8,056,351 B2 * 11/2011 Marciano ..... F24F 13/14 62/239
8,555,669 B1 * 10/2013 LeBlanc ..... F24F 1/14 62/428
11,613,339 B2 * 3/2023 Lewis ..... F24F 13/30 114/211
2001/0001363 A1 * 5/2001 Dodge ..... B63J 2/04 62/240
2002/0017108 A1 * 2/2002 Schooley ..... B63J 2/04 62/240
2005/0092016 A1 * 5/2005 Ozaki ..... B64D 13/06 62/298
2005/0236013 A1 * 10/2005 Huston ..... B63J 2/04 134/1
2010/0251739 A1 * 10/2010 Mabru ..... B63J 2/04 62/240
2014/0360221 A1 * 12/2014 Kyle ..... B63J 2/04 62/426
2022/0126973 A1 * 4/2022 Ripoll ..... F25B 13/00

FOREIGN PATENT DOCUMENTS

KR 100749019 B1 * 8/2007
WO WO-2022162534 A1 * 8/2022

* cited by examiner

SELF-CONTAINED AIR CONDITIONING UNIT WITH SWIVEL GYRO-MOUNT

CROSS-REFERENCE TO RELATED APPLICATIONS

This application is a Continuation-in-Part of co-pending U.S. Non-Provisional patent application Ser. No. 17/175,052, entitled "Self-contained marine air conditioning unit, air-conditioning system, and method of installation", filed Feb. 12, 2021. This application also claims the benefit of priority pursuant to 35 U.S.C. § 119(e) of U.S. Provisional Patent Application Ser. No. 63/436,044, entitled "Swivel Gyro-Mount System for a Self-Contained Air Conditioning Unit", filed Dec. 29, 2022. All of which are hereby incorporated by reference in their entireties for all purposes.

FIELD OF THE INVENTION

The present invention relates to the field of HVAC ductwork and self-contained HVAC systems.

BACKGROUND

Current HVAC technology in the marine industry is adapted to fit in to tight locations with minimal dimensions, such as a utility closet or under a floor panel. Self-contained units are a popular option for installation because the unit comes with all the components needed in a smaller form factor. However, because they are pre-constructed, the orientation of the blower and resulting ductwork is limited to what the current HVAC configuration inside the utility compartment is. This, in turn, limits which units can be installed. Some, including myself, have created rotatable blower assemblies. My U.S. Patent Application Number: 2022/0126973 ('973), along with Frank Marciano's U.S. Pat. Nos. 5,848,536 ('536) and 8,056,351 ('351), discuss different variations of rotatable blowers, some achieving up to 360-degrees of rotation.

Typically these blowers adjust about a single axial direction, whether it be a single axis as I have disclosed in my '973 application and Marciano has disclosed in his '536 patent, or a double axis as Marciano discloses in his '351 patent. However, these orientations limit the blower outlet orientation to two single dimensions, such as an X and/or Y axial direction on an XYZ axial coordinate system. However, when installing a replacement HVAC unit, the installation space may be more difficult to work with than these dual axial directional orientations will allow.

Thus, a need exists in the market for a self-contained HVAC unit that incorporates a blower output orientation capable of an output with directional coordinates in an X axial direction, a Y axial direction, and a Z axial direction, and the combination thereof.

SUMMARY OF THE INVENTION

The invention disclosed herein provides an air conditioning unit having a main body having at least an evaporator with an evaporator cover. The evaporator cover has an aperture, whereby the aperture is bordered on a side opposite of the evaporator by a plurality of frustum-spherical wall sections, thereby creating a boundary, as may be seen in the figures. A frustum-spherical swivel gyro-mount ring is positioned within the boundary of said frustum-spherical wall sections, whereby the frustum-spherical swivel gyro-mount ring is configured to complement dimensions of an interior surface boundary of said plurality of frustum-spherical wall sections. Namely, the dimension of the frustum-spherical swivel gyro-mount ring is configured to nest within the outer boundary. A fitment ring is removably affixed to a protruding lip of the frustum-spherical swivel gyro-mount ring, whereby the fitment ring couples the frustum-spherical swivel gyro-mount ring to a blower assembly. The frustum-spherical wall sections movably contain the frustum-spherical swivel gyro-mount ring in a tight periphery, thereby allowing the frustum-spherical swivel gyro-mount ring to adjust in orientation, whereby the adjustment in orientation influences a direction of airflow in a conical range of orientations to a blower, whereby said blower may expel air in a plurality of selectable directions in a range of angulation resembling a dual conical shape.

The invention disclosed herein further provides a self-contained marine air conditioning unit. The self-contained marine air conditioning unit includes a seawater cooling circuit, a refrigerant circuit, and a blower assembly. The refrigerant circuit includes a reverse valve connecting a compressor, an evaporator, and a refrigerant tube thermally engaged with a titanium condenser coil, wherein the evaporator includes an evaporator cover. The evaporator cover having an aperture, whereby the aperture is bordered on a side opposite of the evaporator by a plurality of frustum-spherical wall sections, thereby creating a boundary. The self-contained marine air conditioner unit also includes a frustum-spherical swivel gyro-mount ring positioned within the boundary of the frustum-spherical wall sections, whereby the frustum-spherical swivel gyro-mount ring is configured to complement dimensions of an interior surface boundary of the plurality of frustum-spherical wall sections. The self-contained marine air conditioning unit also includes a fitment ring removably affixed to a protruding lip of the frustum-spherical swivel gyro-mount ring, whereby the fitment ring couples the frustum-spherical swivel gyro-mount ring to a blower assembly. The seawater cooling circuit includes said titanium condenser coil. The titanium condenser coil may have a titanium condenser coil outflow and a titanium condenser coil inflow. The blower assembly is mounted in communication with the evaporator, wherein the blower assembly may pull air through the evaporator. The self-contained marine air conditioning system also includes an electrical box with fire retardant cover, a universal control board with universal collection terminals, and a power and control source connection incorporated within a single plug.

It is an object of the present invention to provide a system to provide a blower connection ductwork capable of an orientation influenced by three-axial directions.

It is yet another object of the present invention is to provide an air conditioning system capable of fitting in to tight and awkwardly configured spaces.

It is a further object to provide an air conditioning system blower connection capable of rotation greater than 360-degrees.

The drawings and specific descriptions of the drawings, as well as any specific or alternative embodiments discussed, are intended to be read in conjunction with the entirety of this disclosure. The invention may be embodied in many different forms and should not be construed as being limited to the embodiments set forth herein; rather, these embodiments are provided by way of illustration only and so that this disclosure will be thorough, complete, and fully convey understanding to those skilled in the art. The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
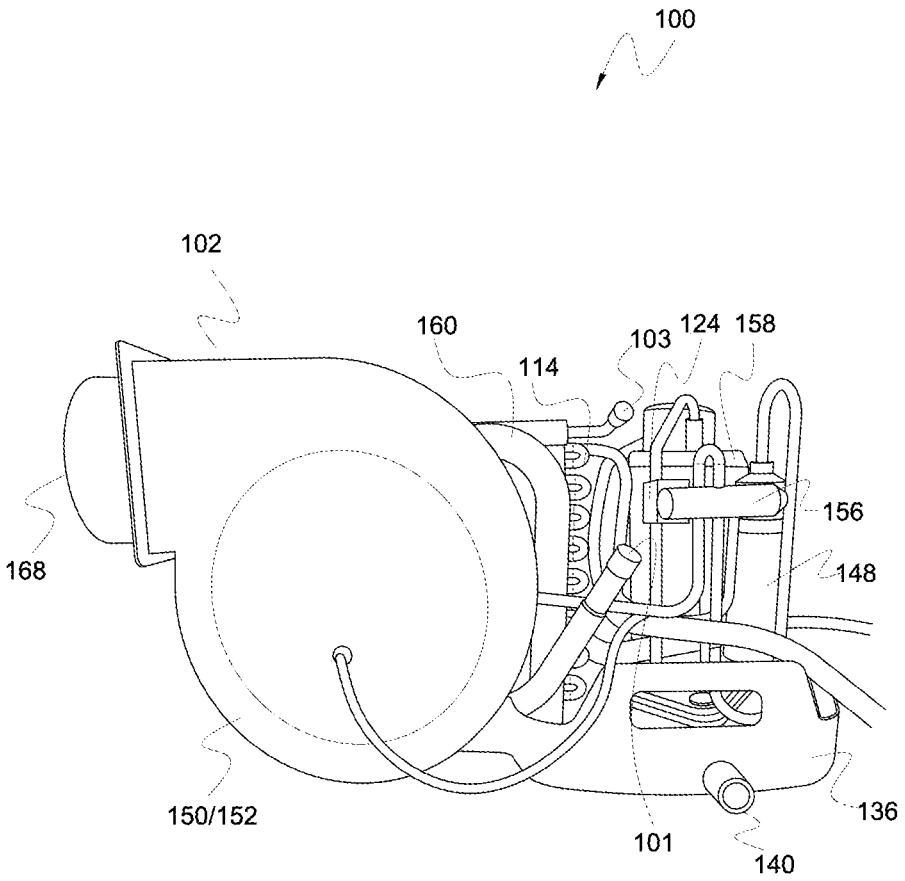
FIG. 1 is a left-side view of the marine air conditioning unit.

The invention herein provides a solution for tight compartments configured to receive air condition units, and for awkward layouts and installations of air conditioning units. The invention includes a uniquely configured swivel gyro-connection duct between the evaporator cover and the blower enclosure capable of a blower output orientation with an output having directional coordinates in an X axial direction, a Y axial direction, and a Z axial direction, and/or the combination thereof, thereby solving the above issues.

As marine watercrafts evolve, the size and amenities provided in the cabin expand. Air conditioners have been adapted to work within marine watercrafts to provide further comfort to the occupants therein. One example of a marine air conditioner is U.S. Pat. No. 5,848,536, which discloses a self-contained marine air conditioner.

Current HVAC technology in the marine industry is adapted to fit in to tight locations with minimal dimensions, such as a utility closet or under a floor panel. Self-contained units are a popular option for installation because the unit comes with all the components needed in a smaller form factor. However, because they are pre-constructed, the orientation of the blower and resulting ductwork is limited to what the current HVAC configuration inside the utility compartment is. This, in turn, limits which units can be installed. Some, including myself, have created rotatable blower assemblies. My U.S. Patent Application Number: 2022/0126973 ('973), along with Frank Marciano's U.S. Pat. Nos. 5,848,536 ('536) and 8,056,351 ('351), discuss different variations of rotatable blowers, some achieving up to 360-degrees of rotation.

Typically these blowers adjust about a single axial direction, whether it be a single axis as I have disclosed in my '973 application and Marciano has disclosed in his '536 patent, or a double axis as Marciano discloses in his '351 patent. However, these orientations limit the blower outlet orientation to two single dimensions, such as an X and/or Y axial direction on an XYZ axial coordinate system. However, when installing a replacement HVAC unit, the installation space may be more difficult to work with than these dual axial directional orientations will allow.

It should be appreciated that the disclosed embodiments herein may be applied to marine HVAC systems but may also be applied to the HVAC industry as a whole, with applicable utilizations in all forms of vehicular air conditioning systems, including but not limited to, trains, watercraft, airplanes, recreational vehicles, small homes, and the like, or in any installation where a compact HVAC unit may be advantageous.

The current invention solves these problems by creating a new system that allows the blower output to be adjusted variably in an X (up and down), Y (rotation), and Z (in and out) directional output. Prior inventions only allow up and down adjustment, as they spin 360-degrees about a single axial plane. The current invention adds in the third dimensional adjustment needed to be viable in applications that are limited by geometrical size and/or awkward positioning. To do this, the swivel gyro-mounting system incorporates several unique pieces that maintain the integrity of the airflow, allow for swivel-ability, and maintain a non-fixed couplement that can be routinely adjusted.

The swivel gyro-mount system for a self-contained air conditioning system disclosed in the present invention may be used to provide a system capable of broad integration into several geometrically limited spaces. The system provides a blower connection ductwork capable of an orientation influenced by three-axial directions, provide an air conditioning system capable of fitting in to tight and awkwardly configured spaces, and provide an air conditioning system blower connection capable of rotation greater than 360-degrees. This apparatus and system are particularly shown in FIGS. 1-23.

The inventive disclosure herein also provides for a self-contained marine air conditioning unit 100, which can be easily implemented as a do-it-yourself installed system, as can be primarily seen in FIGS. 1-23. The marine air conditioning unit 100 has a blower assembly 102 containing a blower fan with a motor, an evaporator 114, a dryer 148, reverse valve 156, compressor 158, condenser coil 160, a high-pressure switch 124, an electrical box 170 acting as a power supply, and a universal control board 174.

The unit 100 includes a seawater cooling circuit and a refrigerant circuit. The unit 100 also includes and a blower assembly 102 for moving air through the cooling parts of the air conditioning unit 100. The blower assembly 102 is mounted in communication with said evaporator 114, wherein said blower assembly 102 may pull air through said evaporator 114. The refrigerant circuit includes the reverse valve 156, wherein the reverse valve 156 connects the compressor 158, the evaporator 114, and a refrigerant tube 262 thermally engaged with the titanium condenser coil 160. This thermal engagement allows for a thermal transfer between the temperature of the refrigerant in the tube and the seawater in the titanium condenser coil 160. The seawater cooling circuit includes the titanium condenser coil 160. The titanium condenser coil 160 has a titanium condenser coil outflow and a titanium condenser coil inflow.

Figure 8:
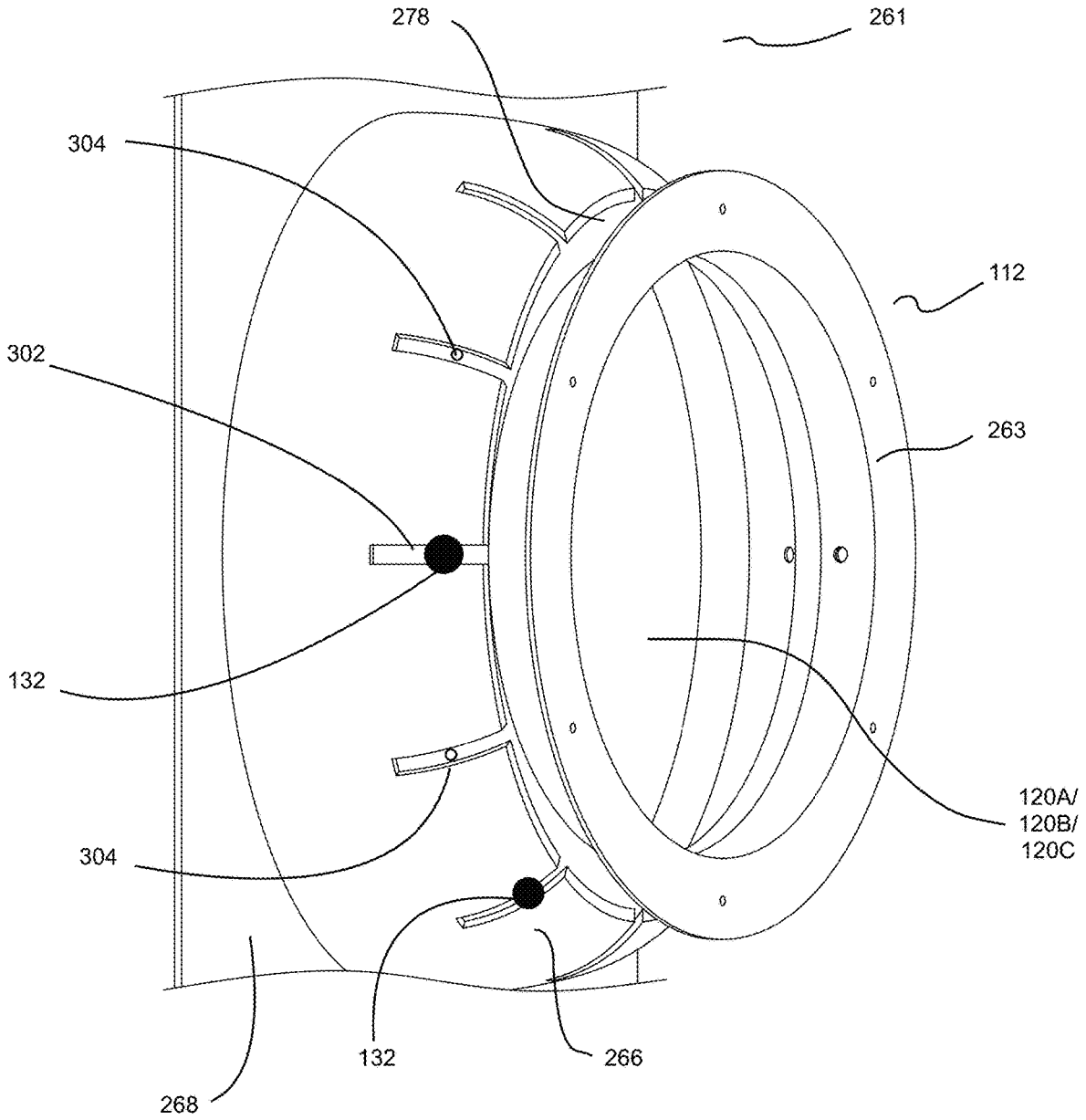
FIG. 8 illustrates a conceptual perspective view of the swivel gyro-mount for blower with output swiveled in a side direction.
Figure 9:
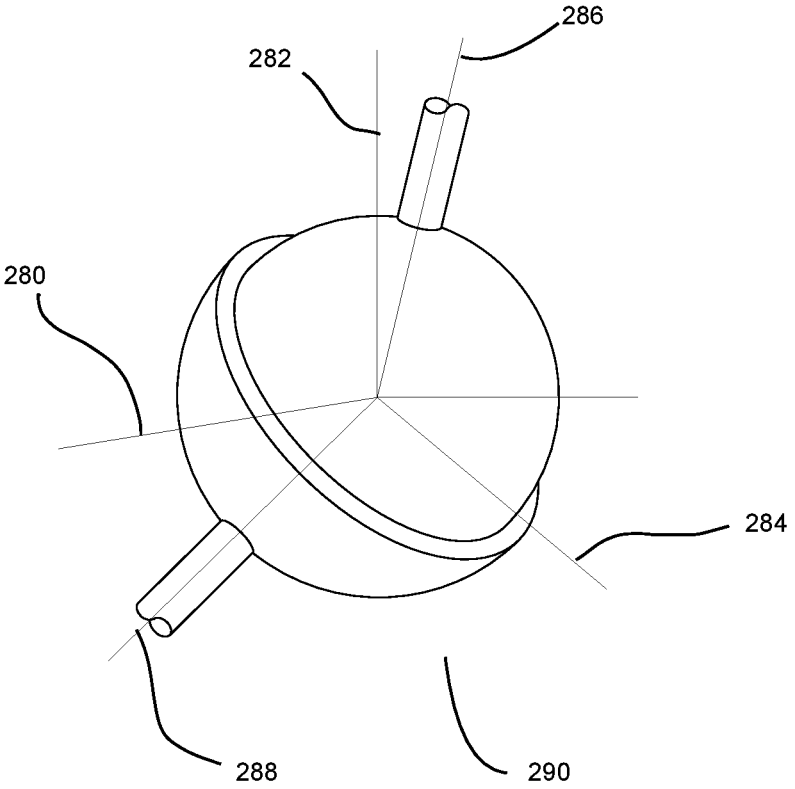
FIG. 9 illustrates a conceptual view of the swivel gyro principles.
Figure 10:
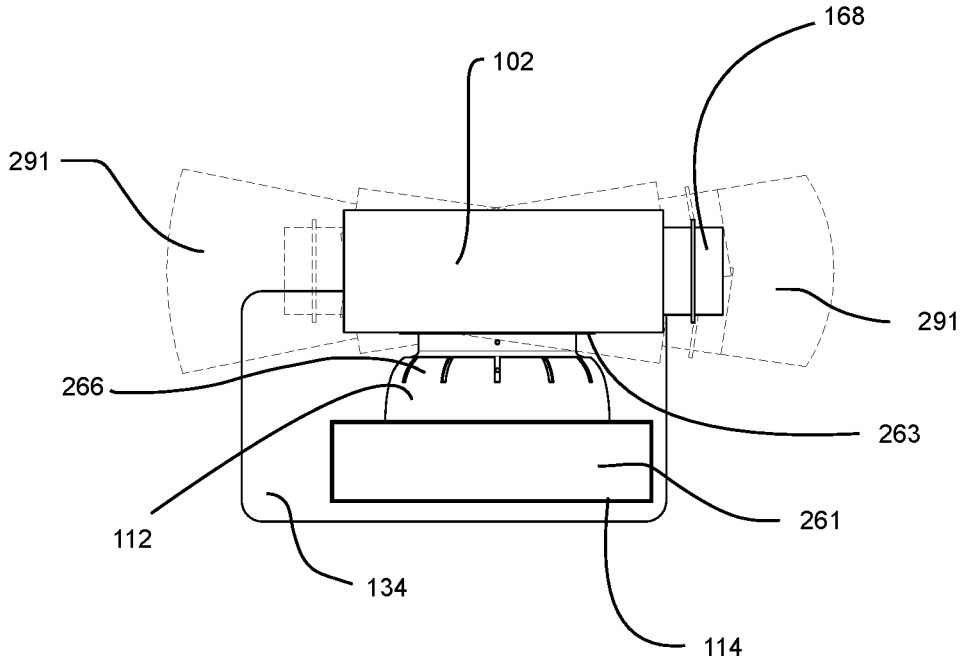
FIG. 10 is a top view of the marine air conditioning unit isolating the evaporator cover, swivel gyro-mount for blower, and blower.
Figure 11:
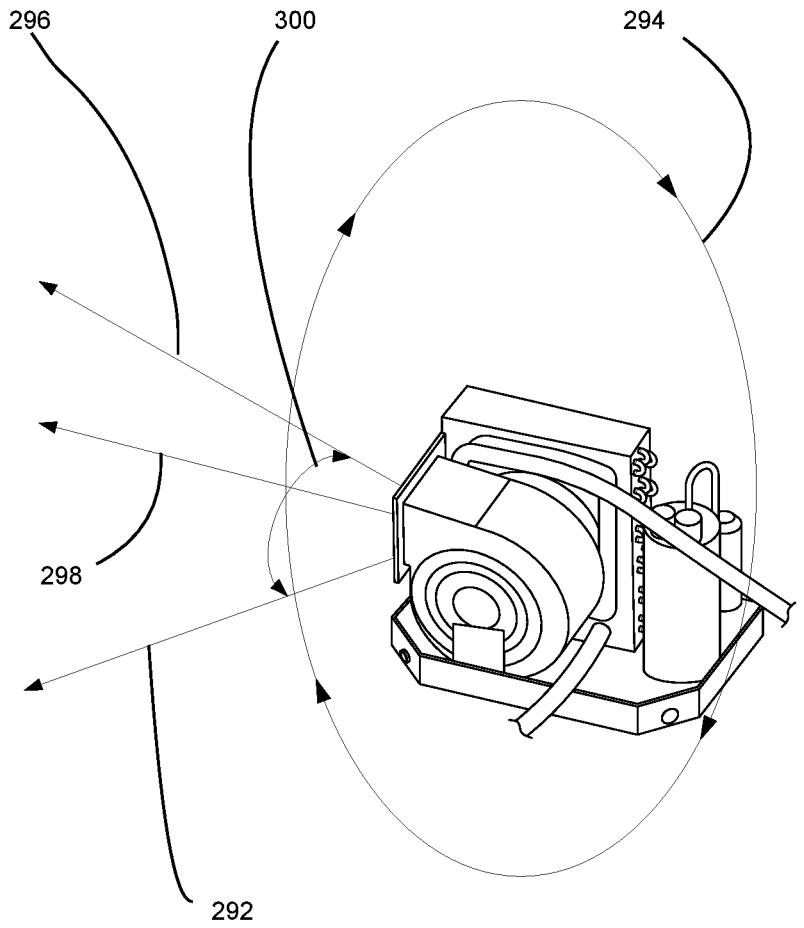
FIG. 11 illustrates a directional airflow, indicating inward and outward rotatability and 360-degree rotatability.

The marine air conditioning unit 100 and its components can be primarily seen in FIGS. 1-8 and 12-16. FIGS. 9-11 show the conceptual rotatability. FIGS. 17-23 show the overall system, installation, and components.

Figure 2:
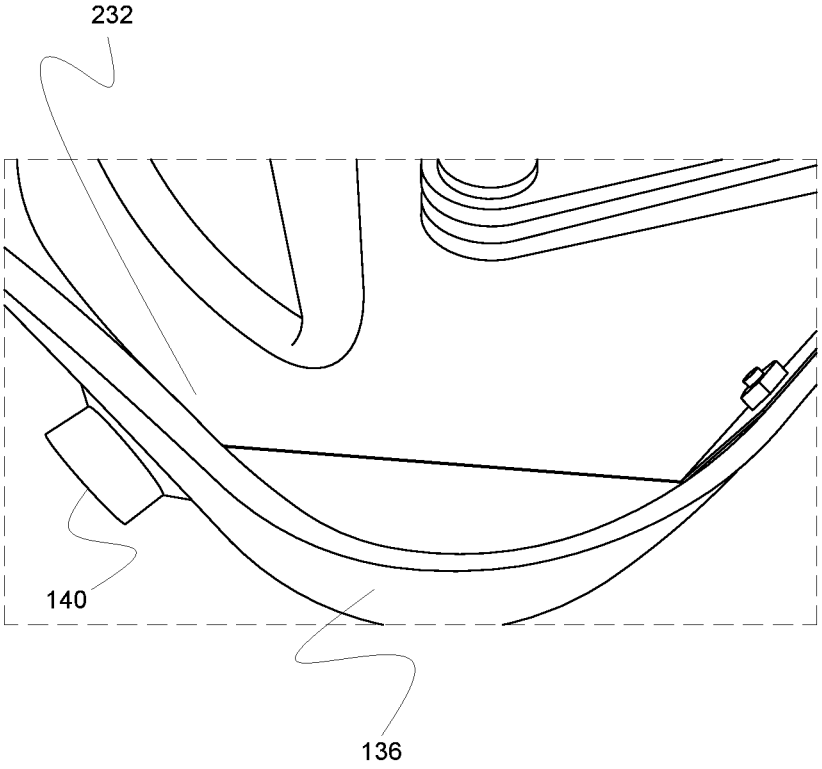
FIG. 2 is an enlarged view of the back left corner of the base drain pan of the marine air conditioning unit.
Figure 3:
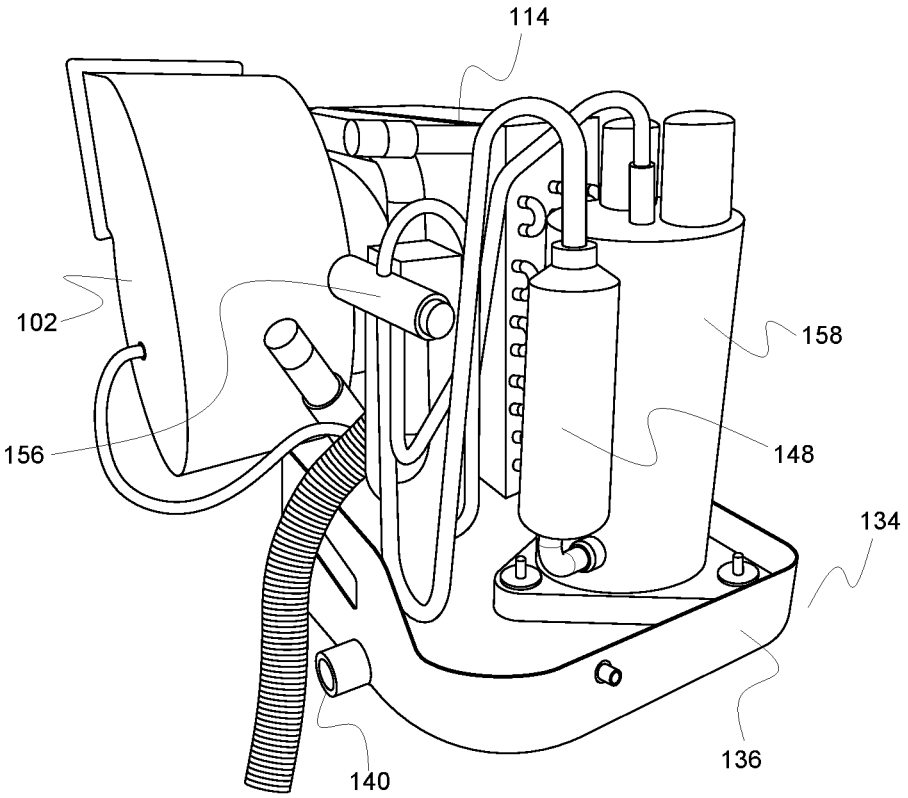
FIG. 3 is a rear left perspective view of the marine air conditioning unit.
Figure 4:
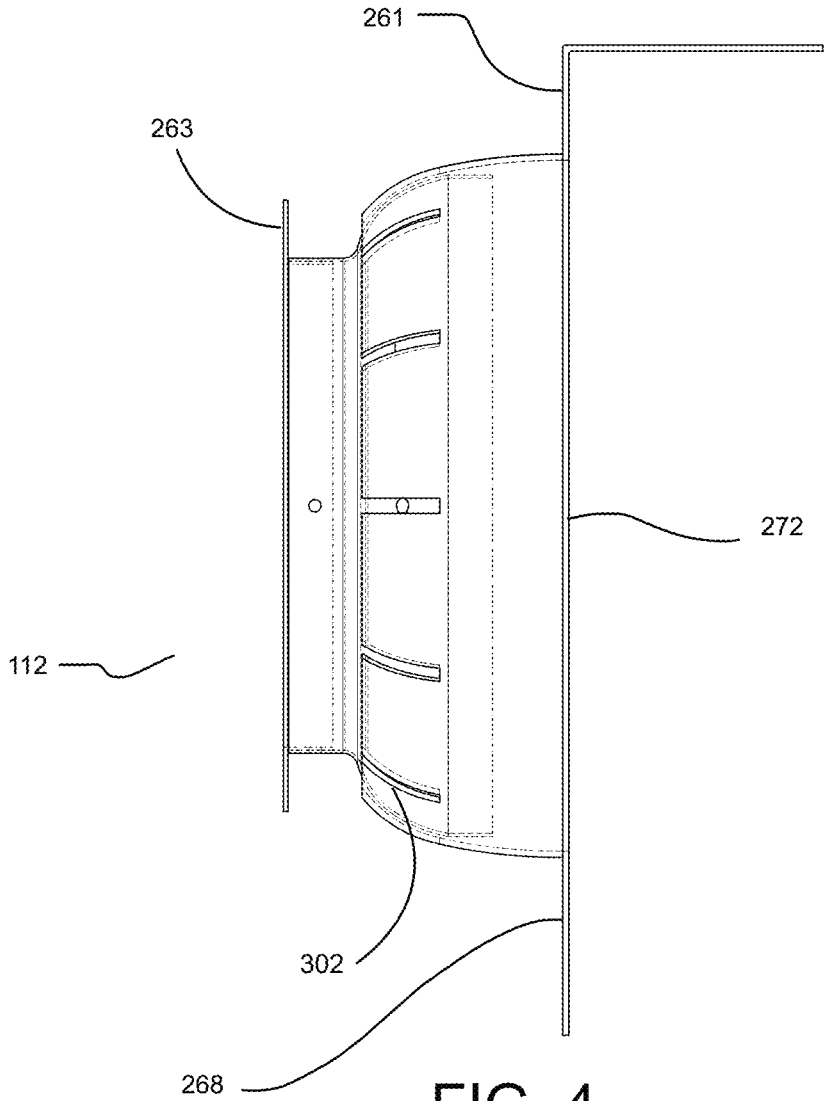
FIG. 4 illustrates a side elevational view of the evaporator cover with swivel-gyro mount.
Figure 5:
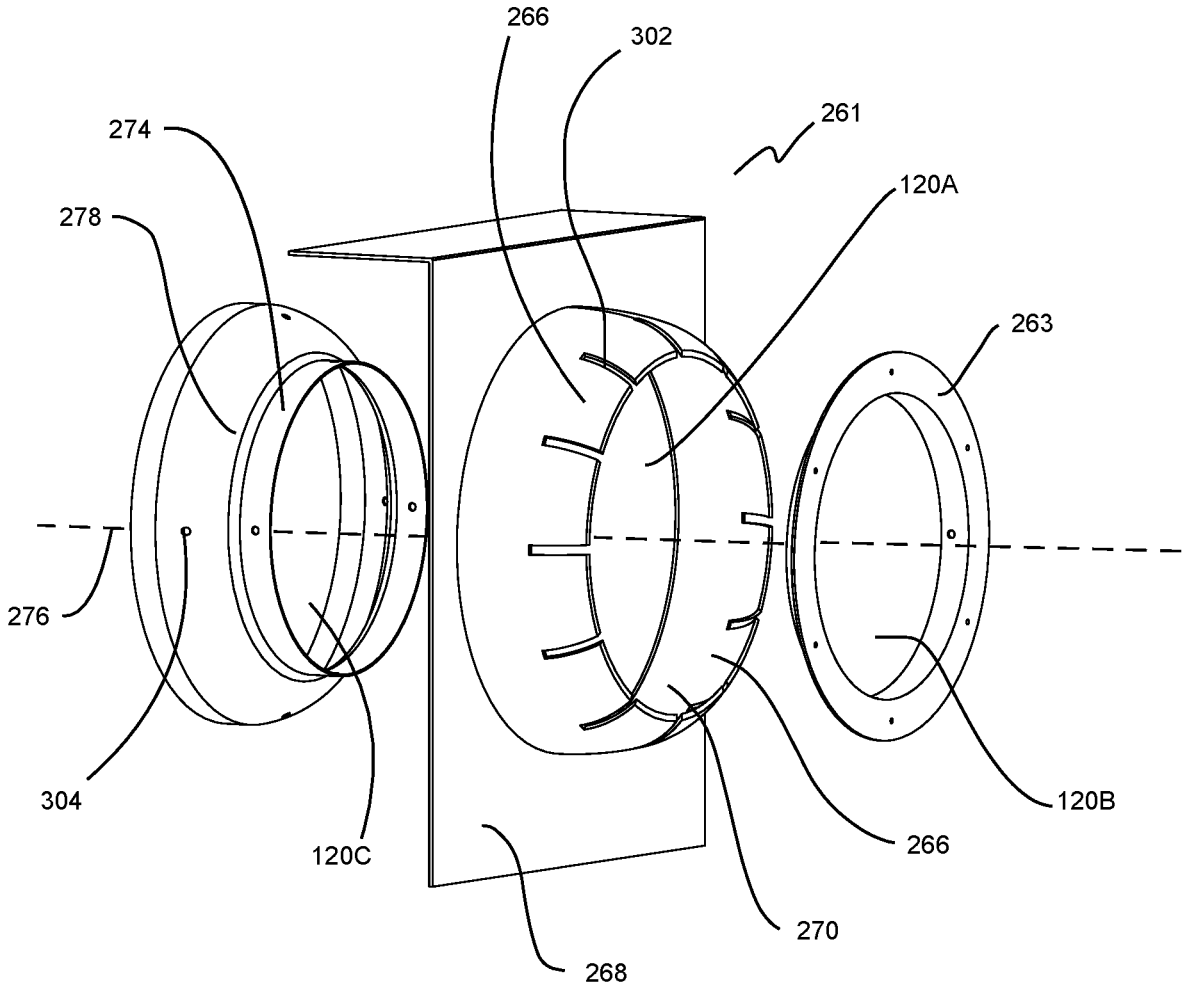
FIG. 5 illustrates a side perspective exploded view with guideline on the order of engagement of the swivel gyro-mount for blower mount.
Figure 6:
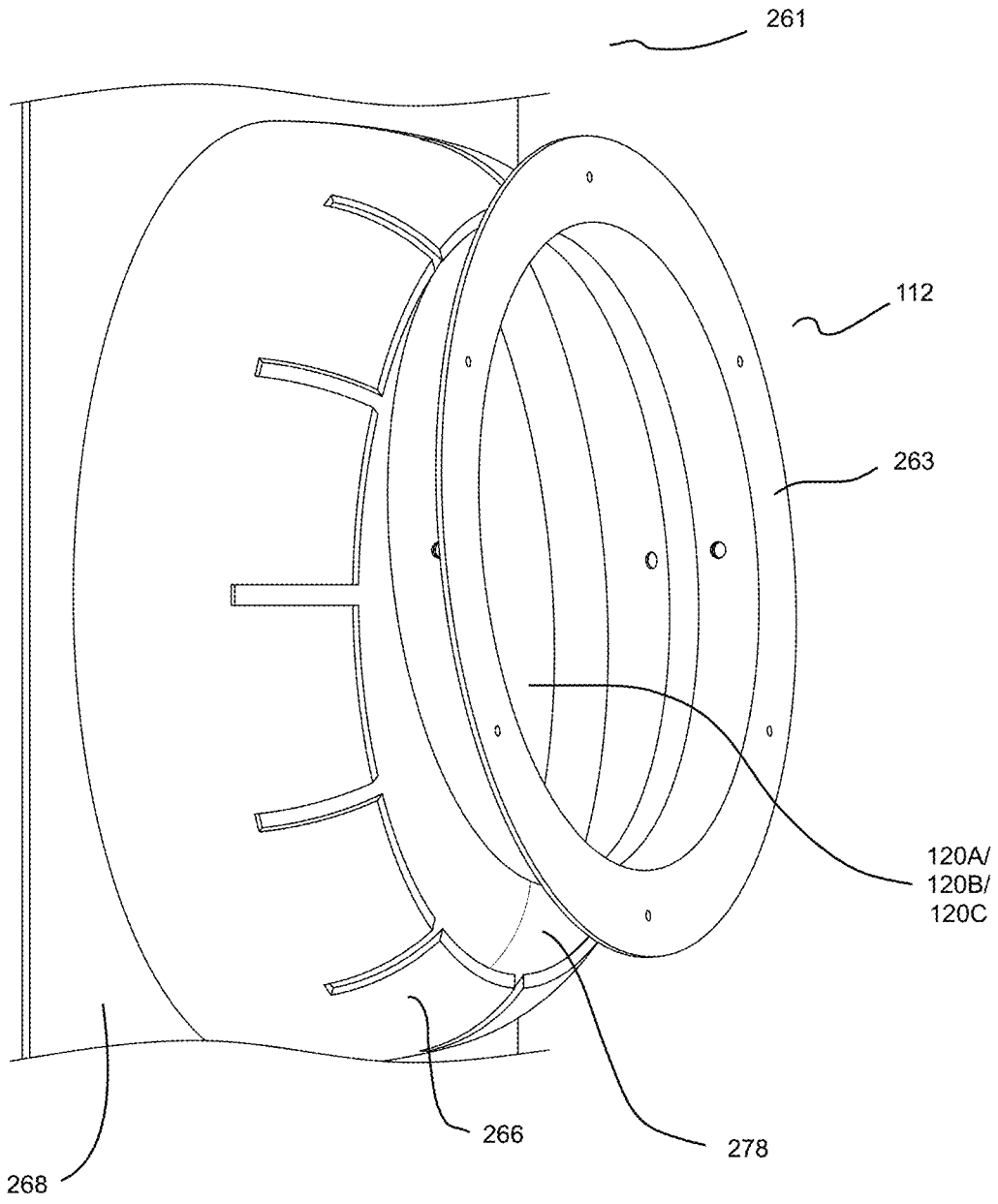
FIG. 6 illustrates a conceptual perspective view of the swivel gyro-mount for blower with output swiveled in an upward direction.
Figure 7:
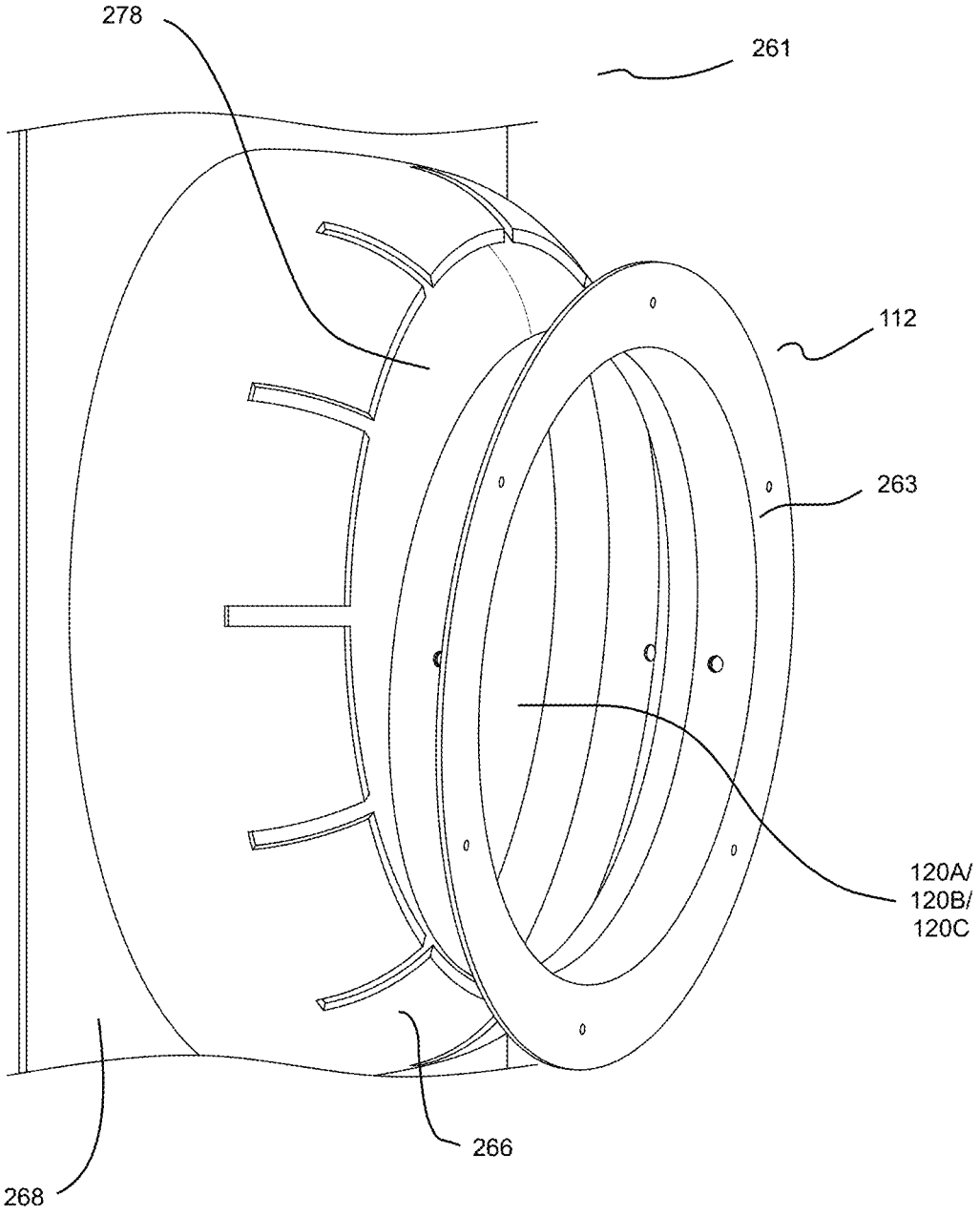
FIG. 7 illustrates a conceptual perspective view of the swivel gyro-mount for blower with output swiveled in a downward direction.
Figure 12:
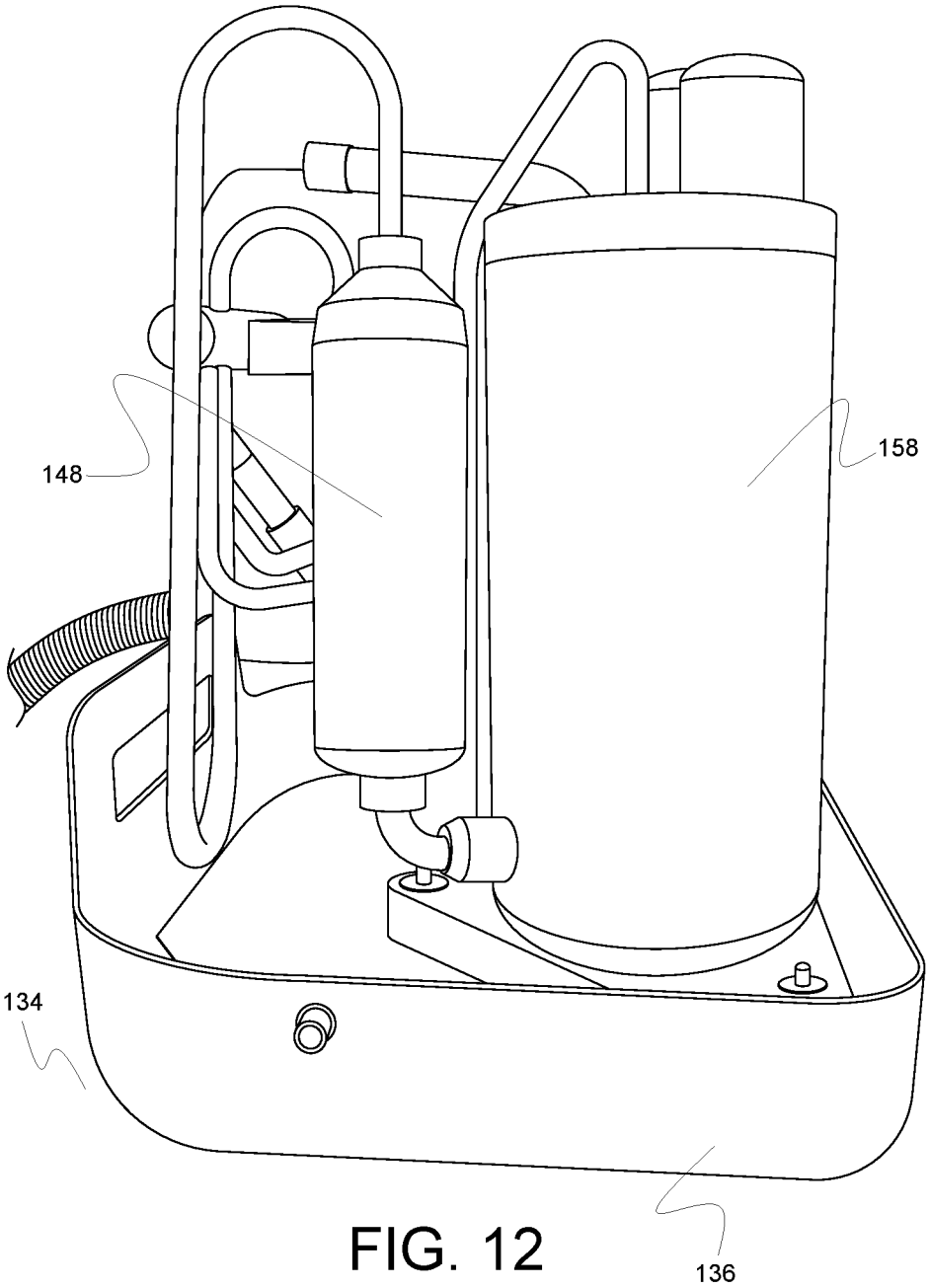
FIG. 12 is a rear view of the marine air conditioning unit.
Figure 13:
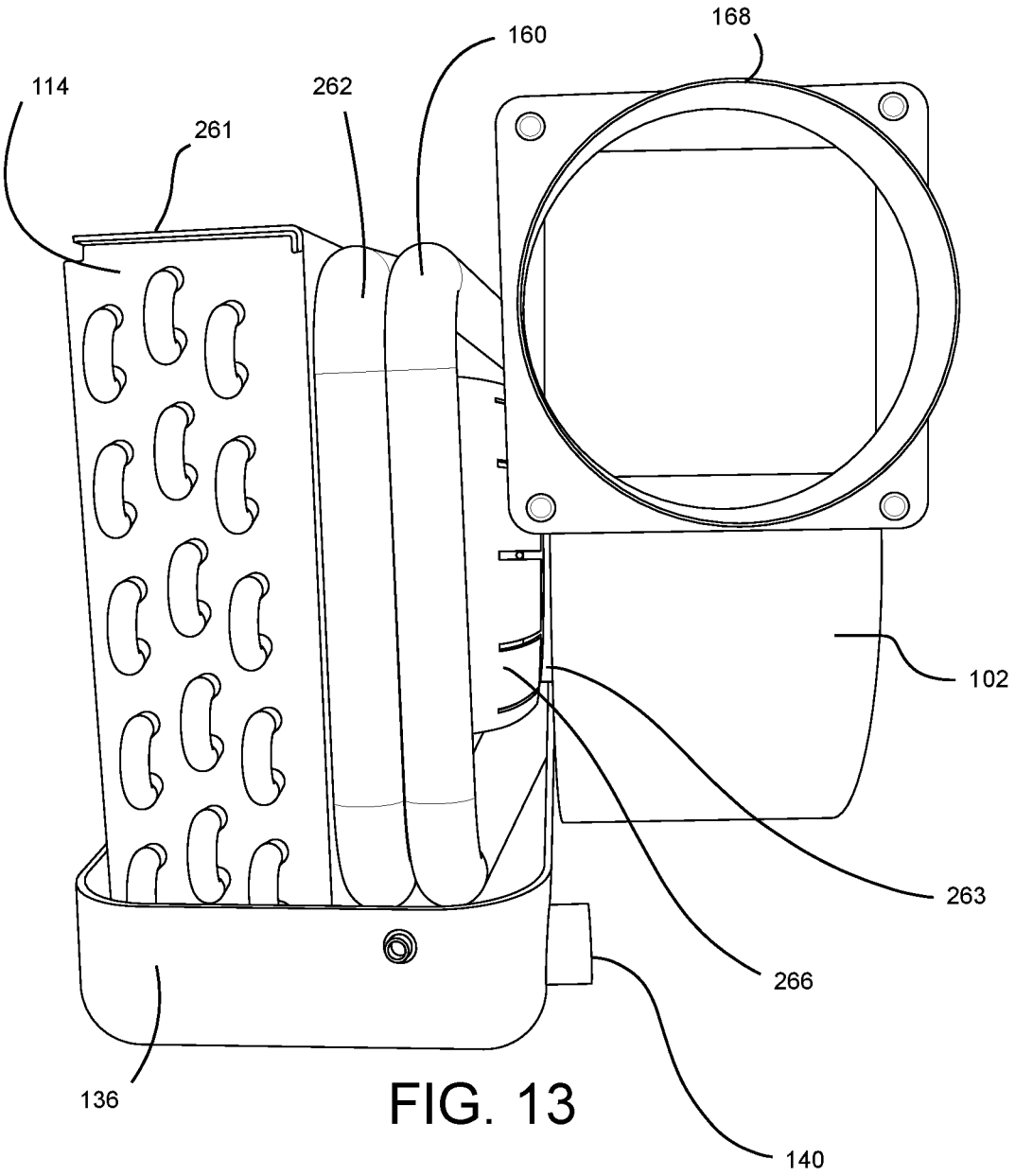
FIG. 13 is a front view of the marine air conditioning unit.
Figure 14:
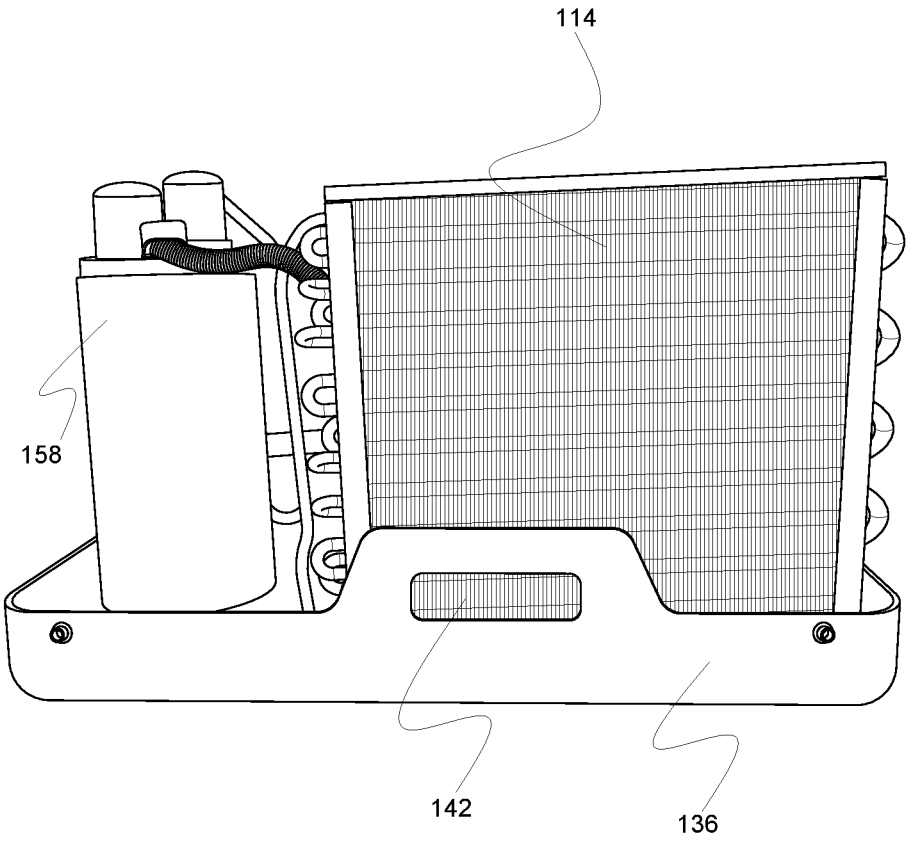
FIG. 14 is a right view of the marine air conditioning unit without evaporator filter.
Figure 15:
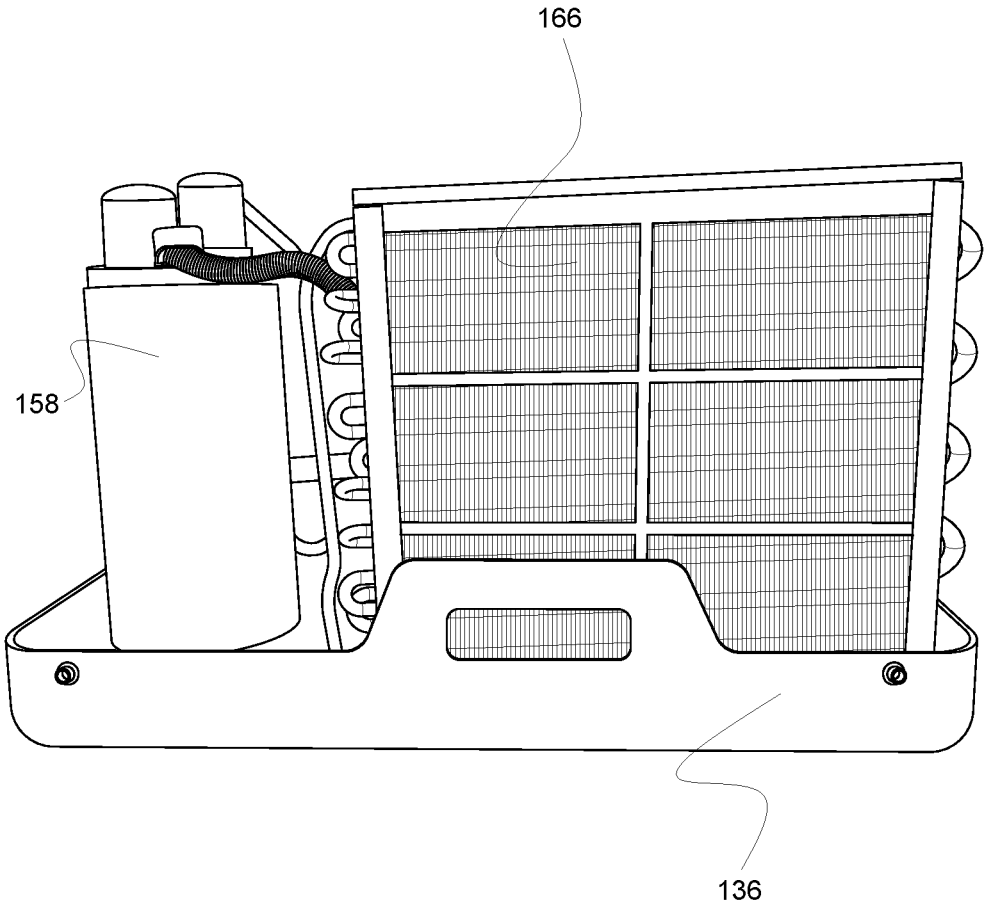
FIG. 15 is a right view of the marine air conditioning unit with evaporator filter.
Figure 16:
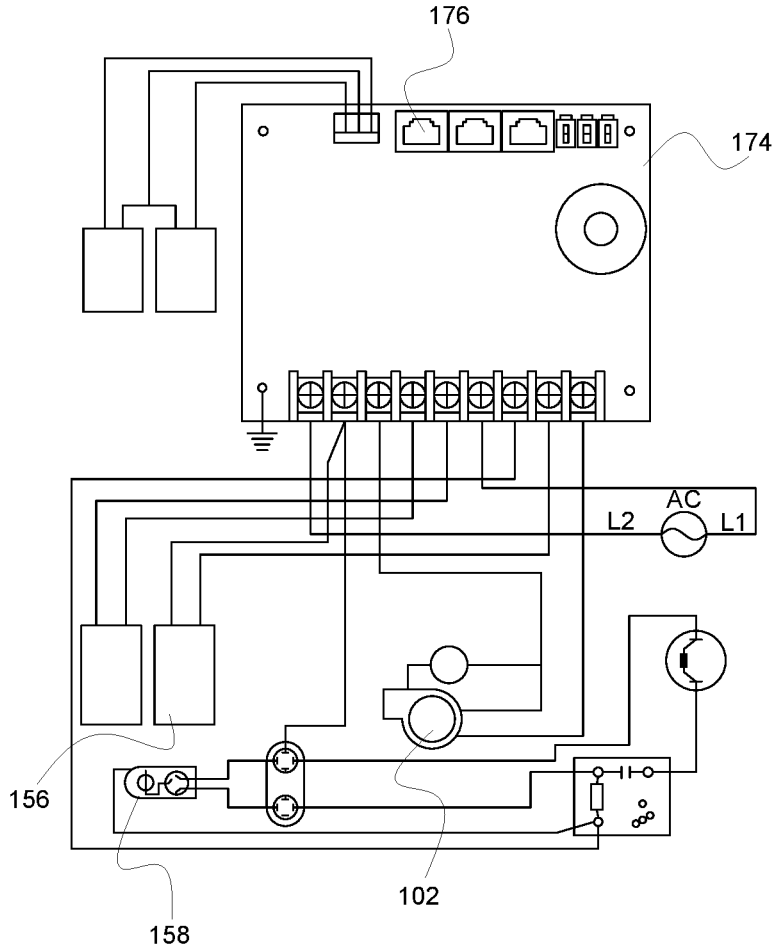
FIG. 16 is a wiring diagram of the universal control board of the marine air conditioning unit.
Figure 17:
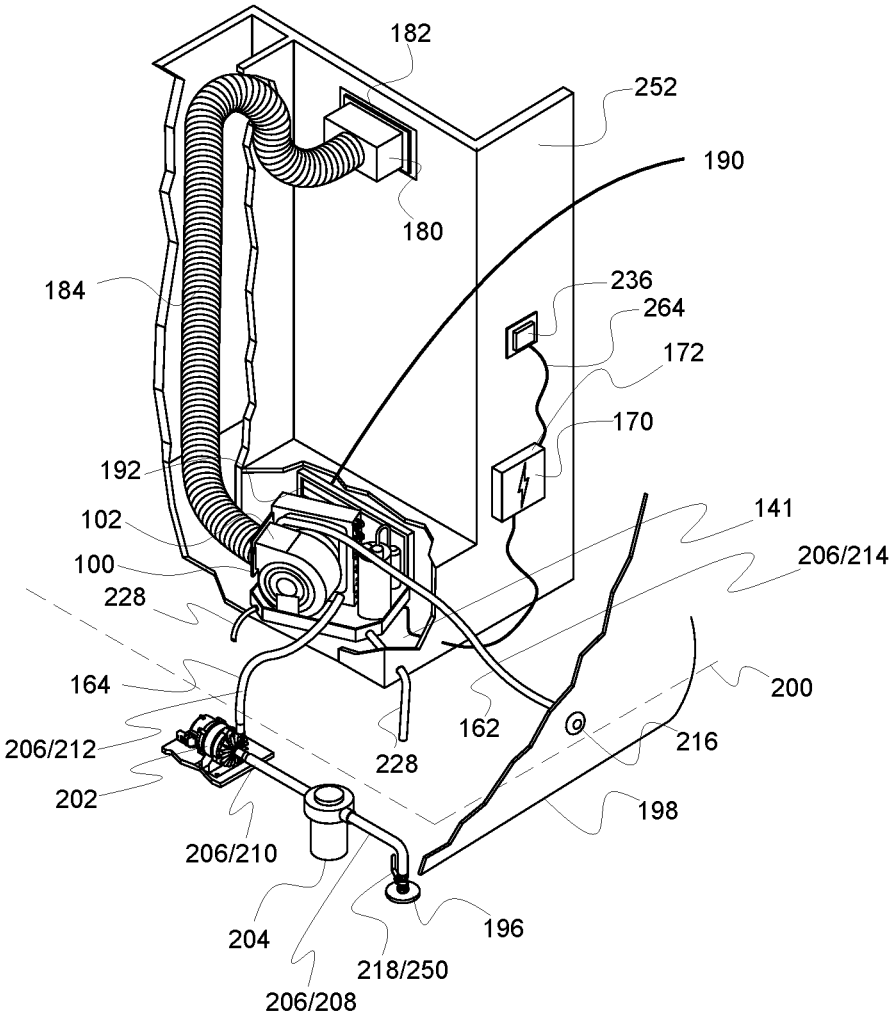
FIG. 17 is a conceptual overview of a marine air conditioning system.
Figure 18:
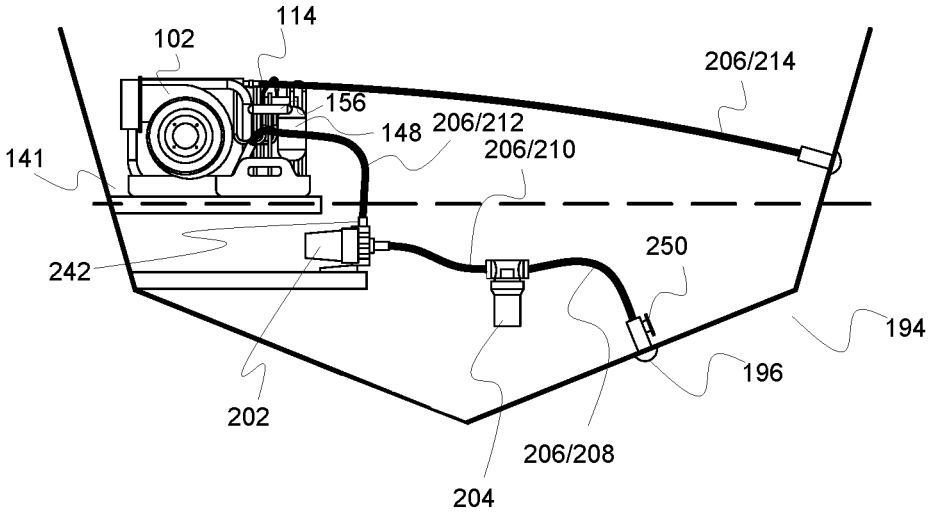
FIG. 18 is a conceptual cross-section view of a hull of a watercraft showing the layout of the seawater cooling system of a marine air conditioning system.
Figure 19:
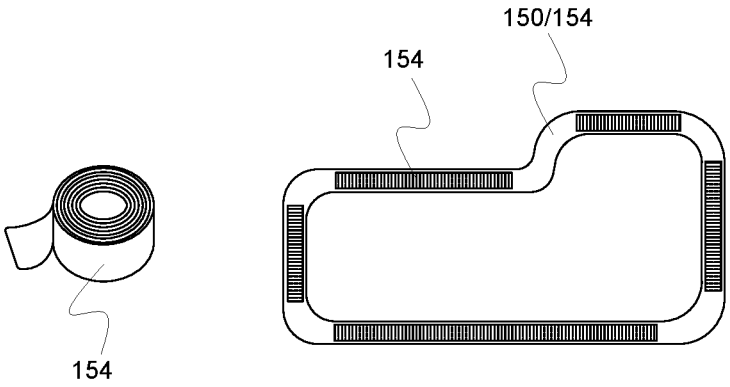
FIG. 19 is a view of the vibration absorbing adhesive tape.
Figure 20A:
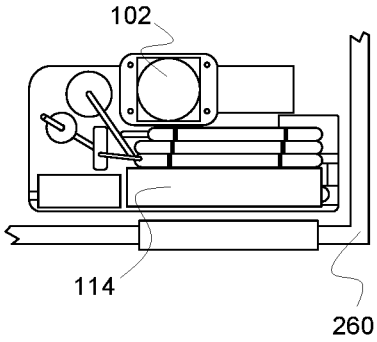
FIG. 20A is a view of a mounting location of the marine air conditioning unit with evaporator parallel to an air return.
Figure 20B:
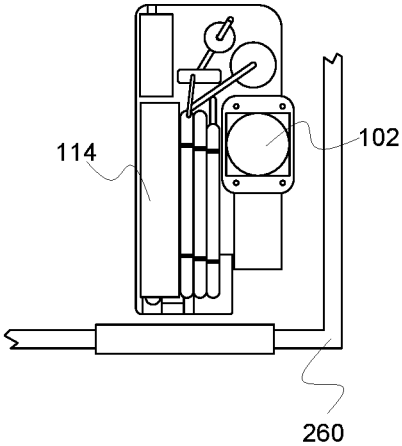
FIG. 20B is a view of a mounting location of the marine air conditioning unit with evaporator perpendicular to an air return.
Figure 21A:
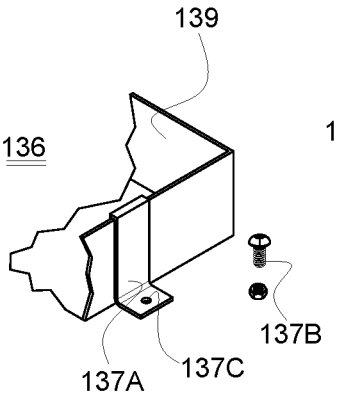
FIG. 21A is an enlarged perspective view of a base drain pan mounting bracket.
Figure 21B:
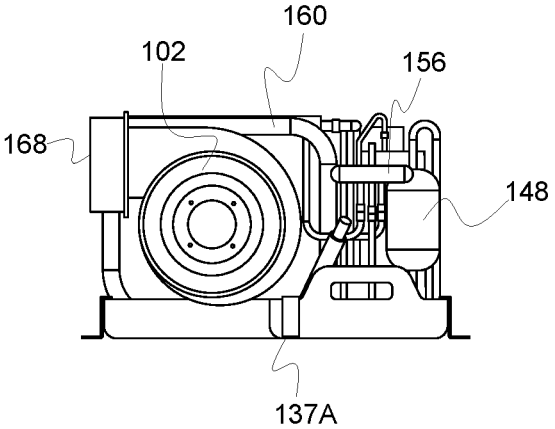
FIG. 21B is a left side view of the marine air conditioning system, showing the location of mounting brackets.
Figure 22A:
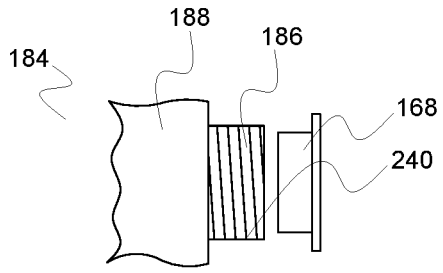
FIG. 22A is a side view of an insulated duct aligning up with a duct mount.
Figure 22B:
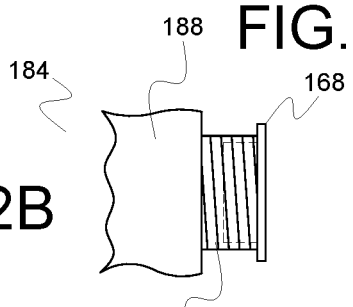
FIG. 22B is a side view of an insulated duct engaging with a duct mount.
Figure 22C:
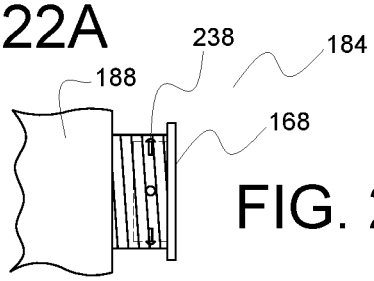
FIG. 22C is a side view of an engaged insulated duct and duct mounting ring with securement screws.
Figure 22D:
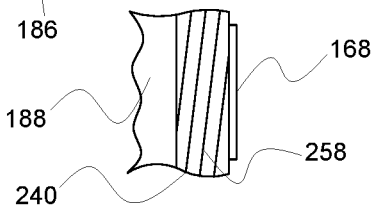
FIG. 22D is a side view of an engaged insulated duct and duct mounting ring sealed with condensation inhibiting tape.
Figure 23:
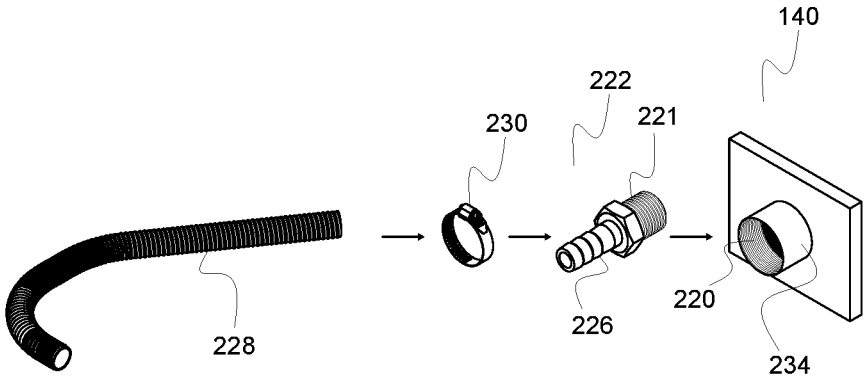
FIG. 23 is an exploded view of a condensate drain, and drain hose components.

FIG. 1 is a left-side view of the marine air conditioning unit 100. FIG. 2 is an enlarged view of the back left corner of the base drain pan 136 of the marine air conditioning unit 100. FIG. 3 is a rear left perspective view of the marine air conditioning unit 100. FIG. 4 illustrates a side elevational view of the evaporator cover 261 with swivel-gyro mount 112. FIG. 5 illustrates a side perspective exploded view with guideline 276 on the order of engagement of the swivel gyro-mount for blower 112. As may be further seen in FIG. 5, the swivel gyro-mount 112 for blower comprises three main structural features, namely, swivel gyro ring 278, evaporator cover 261, and fitment ring 263, together with their structural features. FIG. 6 illustrates a conceptual perspective view of the swivel gyro-mount 112 for blower with output swiveled in an upward direction. FIG. 7 illustrates a conceptual perspective view of the swivel gyro-mount 112 for blower with output swiveled in a downward direction. FIG. 8 illustrates a conceptual perspective view of the swivel gyro-mount 112 for blower with output swiveled in a side direction. FIG. 9 illustrates a conceptual view of the swivel gyro principles, including the X axial direction 282, Y rotational axis 284, and Z axial in and out 280 directions, with the ball swivel couplement 290 and directional orientations 286 and 288. FIG. 10 is a top view of the marine air conditioning unit isolating the evaporator cover 261, swivel gyro-mount 112 for blower, and blower 102. FIG. 11 illustrates a directional airflow 298, indicating inward 296 and outward 292 rotatability and 360-degree rotatability 294. FIG. 12 is a rear view of the marine air conditioning unit 100. FIG. 13 is a front view of the marine air conditioning unit 100. FIG. 14 is a right view of the marine air conditioning unit 100 without evaporator filter. FIG. 15 is a right view of the marine air conditioning unit 100 with evaporator filter 166. FIG. 16 is a wiring diagram of the universal control board 174 of the marine air conditioning unit. FIG. 17 is a conceptual overview of a marine air conditioning system. FIG. 18 is a conceptual cross-section view of a hull of a watercraft showing the layout of the seawater cooling system of a marine air conditioning system. FIG. 19 is a view of the vibration absorbing adhesive tape 154. FIG. 20A is a view of a mounting location of the marine air conditioning unit with evaporator 114 parallel to an air return. FIG. 20B is a view of a mounting location of the marine air conditioning unit with evaporator 114 perpendicular to an air return. FIG. 21A is an enlarged perspective view of a base drain pan 136 mounting bracket 137A. FIG. 21B is a left side view of the marine air conditioning system 100, showing the location of mounting brackets 137A. FIG. 22A is a side view of an insulated duct 184 aligning up with a duct mount. FIG. 22B is a side view of an insulated duct 184 engaging with a duct mount. FIG. 22C is a side view of an engaged insulated duct 184 and duct mounting ring with securement screws. FIG. 22D is a side view of an engaged insulated duct 184 and duct mounting ring sealed with condensation inhibiting tape. FIG. 23 is an exploded view of a condensate drain 140, and drain hose components.

The blower assembly 102 is incrementally rotatable beyond 360-degrees about a multi-dimensional axial system. This allows the blower unit to be installed in a variety of locations. This is also an important feature when using this unit as a replacement unit, because the user is installing this in a location that is not directly configured for the marine air conditioner herein.

The blower assembly 102 has an inlet and an outlet. The blower assembly 102 is mounted at the inlet, wherein the blower fan is driven by a motor, and can pull air through the marine air-conditioning unit. The outlet of the blower assembly 102 may then be connected to an insulated duct through use of a duct mounting ring 168, wherein the cool air is expelled from the marine air-conditioning unit 100 into the remainder of the system.

In order to mount the blower assembly 102 to the body of the marine air-conditioning unit 100, a fitment ring 263 is fastened to the blower assembly 102 via connecting screws, which secures the bracket on to the blower.

Also between the evaporator 114 and the blower assembly 102 is a swivel gyro-mount 112 for blower comprising a cover 261 having an evaporator side 272 and a side opposite of evaporator side as a blower side 268. The evaporator side 272 of the cover 261 is configured to cover the evaporator 114. The blower side 268 of the cover 261 includes a central aperture 120A of the cover 261, aperture 120C of the swivel gyro-mount ring 278, and aperture 120B within the fitment ring 263. The aperture 120A is bordered on a side 268 opposite of the evaporator 114 by a plurality of frustum-spherical wall sections 266, thereby creating a boundary, as may be seen in the FIGS. 4-8. A swivel gyro-mount ring 278 is positioned within the boundary of said frustum-spherical wall sections 266, whereby the swivel gyro-mount ring 278 is configured to complement dimensions of an interior surface boundary 270 of said plurality of frustum-spherical wall sections 266. Namely, the dimension of the swivel gyro-mount ring is configured to nest within the outer boundary. A fitment ring 263 is removably affixed to a protruding lip 274 of the swivel gyro-mount ring 278, whereby the fitment ring 263 couples the swivel gyro-mount ring 278 to a blower assembly, a combination of which may be appreciated in FIGS. 5-8.

This arrangement of components for connecting the blower assembly 102 allows the blower to be variably rotated above 360-degrees, including inward and outward rotation. This can be primarily seen in FIGS. 6-8 and 10-11. FIG. 6 illustrates a conceptual perspective view of the swivel gyro-mount for blower 112 with output swiveled in an upward direction. FIG. 7 illustrates a conceptual perspective view of the gyre-swivel gyro-mount 112 for blower with output swiveled in a downward direction. FIG. 8 illustrates a conceptual perspective view of the gyre-swivel gyro-mount 112 for blower with output swiveled in a side direction. FIG. 5 illustrates a side perspective exploded view with guideline on the order of engagement of the swivel gyro-mount 112 for blower. The connections of these components are locked when the screws 132 are added, which removes the possibility of the connection slipping or moving when the marine air-conditioning unit 100 is on, even in the presence of vibrations, which have been cause for duct misalignment and connection failures that have plagued the prior art.

The unit also contains a base 134 having a base drain pan 136, at least one condensate drain 140, and at least two handles 142. The base 134 is a stainless-steel frame base, which provides support in carrying the weight of the other components and provides a degree of corrosion resistance. The base drain pan 136 is molded into a unitary piece of ABS plastic. This also provides for corrosion protection, and allows for the system to prevent leaking on to the surface in which the unit is mounted to. Also molded into the base drain pan 136 are a plurality of at least two handles 142 formed with the material of the base drain pan 136 and are configured to be located near the heaviest points at the base 134 of the marine air conditioning 100 unit to provide a stable point for a user to pick up the unit 100. While handles in general typically exist at the distal ends of a surface which is intended to be picked up, the weight distribution of air conditioning units can be inconsistently spread out. In a do-it-yourself installation as described herein, the marine air-conditioning unit 100 must be as user-friendly as possible for non-professionals. Therefore, in an ideal embodiment, one handle is located proximal to the evaporator 114 and a second handle is located proximal to the dryer 148. Other handles may also be spread out around the base drain pan, which can be used by a second user helping to carry the marine air-conditioner.

To reduce noise and unwanted shaking, sound and vibration dampening elements 150 are included with the invention. Sounds can become a nuisance, as well as excessive vibration, which can cause shaking or also sounds. Therefore, this invention includes vibration and sound dampening elements 150 already installed so that a user in a do-it-yourself installation does not need to have a professional technician come to install these elements. The vibration dampening elements 150 can include an adhesive foam 152 affixed to an outer surface of the blower assembly 102, a vibration absorbing adhesive tape 154 configured to be affixed to the underside (not shown, but may be appreciated by an underside of the footprint created by the base drain pan 136, and adhesive tape 154) of the base drain pan 136, or both. The adhesive foam 152 around the blower absorbs sound from the motor and fan. However, it also insulates the blower and seals any potential leaks wherein chilled air may escape.

The system uses seawater to cool the unit. Because the system uses seawater as a coolant, the condenser coil 160 included is constructed out of titanium to reduce corrosion. Other materials may not be able to withstand constant filtering of seawater as well, and while other materials may technically work, the system's configuration as a do-it-yourself unit uses the titanium to reduce maintenance and extend the life of the unit. The marine air-conditioning unit 100 also includes a coil inflow 164 and a coil outflow 162.

An air filter 166 attached to the evaporator 114 is also included to filter particulates from entering the system. The filter is configured to be thin and take up a minimal footprint, and is constructed to be reusable because of this unique aspect.

The system is powered and controlled through an electrical box 170 with fire retardant cover 172, connected to a single plug 264 connection. Inside the electrical box are a power supply (not shown) and a universal control board 174 with universal connection terminals 176. The universal control board 174 allows the system to be a replacement unit for third-party marine air-conditioning units, making the overall system an easy installation for a do-it-yourself user. In addition, the system uses a single plug 264 to provide both power and control to the unit, making it further easier for do-it-yourself installations because users only need to connect a single plug 264, rather than mess with wiring and connecting multiple cords. FIG. 16 is a wiring diagram of the universal control board of the marine air conditioning unit.

In a standard configuration, the system will have two cooling circuits, the seawater cooling circuit and refrigerant circuit. In the coolant circuit, the reverse valve 156 connects to the compressor 158, evaporator 114, condenser coil 160, and accumulator. Refrigerant flows from the evaporator 114 to the reverse valve 156, then from the reverse valve 156 to the accumulator and then the compressor 158. The refrigerant will flow from the compressor 158 back through the reverse valve 156 to the condenser coil 160, and then back to the evaporator 114 completing the cycle. Typically, a dryer 148 will be included between the condenser coil 160 and the evaporator 114. The Seawater cooling system 194 is another circuit that brings in fresh seawater and cycles it through the condenser coil 160. However, the seawater circuit does not mix with the refrigerant circuit.

When the air-conditioning unit is in use, ambient air is pulled from the cabin of the watercraft through the grill for the air return 192 by suction created from the blower 102. The air is then pulled passed the coils of the evaporator 114 and into the blower assembly 102. The evaporator 114 cools the ambient air, and the cooled air flows out of the blower 102 and through the thermal foil duct hose 186 and expelled through the grill for the air supply 182 back into the cabin of the watercraft.

The marine air-conditioning unit is part of a larger marine air conditioning system, which can be more particularly seen in FIGS. 17 and 18. FIG. 17 is a conceptual overview of a marine air conditioning system. FIG. 18 is a conceptual cross-section view of a hull of a watercraft showing the layout of the seawater cooling system of a marine air conditioning system. In some do-it-yourself installations, components of this marine air-conditioning system may already be pre-installed on a watercraft. However, in new installations and new watercraft builds, the marine air-conditioning unit must be attached to the additional components of a marine air-conditioning system to function properly.

In addition to the marine air-conditioner unit 100 described above, the marine air-conditioning system also includes an air supply 180, a grill for the air supply 182, an insulated duct 184 connecting the blower assembly 102 to the air supply 180, an air return 190, a grill for an air return 192, a seawater cooling system 194, a thru-hull inlet 196, a pump 202, a strainer 204, marine-grade hoses and piping 206, a coil inflow 164, marine-grade hose 212, a coil outflow 162 hose 214, an overboard seawater discharge 216, a shut-off valve 218, at least one condensate drain 140, and a system control display unit 236.

In this system, air is pulled in through the grill for the air return 192 and across the coils of the evaporator 114 by the suction created by the blower fan. As the air passes the coils of the evaporator 114, the air is cooled and is then pushed out of the blower assembly 102 into the thermal foil duct hose 186 of the insulated duct 184. The cooled air then escapes through the grill for the air supply 182 and into the cabin of the watercraft.

The thermal foil in the thermal foil duct hose 186 may be biaxially-oriented polyethylene terephthalate, known more commonly by its trade name, Mylar®.

The air return 190 is located in close proximity to the evaporator 114 of the marine air conditioning unit. This is so that the marine air-conditioning unit 100 may pull in air with minimal intake ductwork. The air return grill 192 provides protection for the unit to keep out unwanted objects from the cabin that may interfere with the unit.

Because the system is installed on a watercraft, which typically runs off of its own power, be it by generators or batteries, the system configured for maximum efficiency. To further this efficiency, the insulated duct 184 connecting the blower assembly 102 to said air supply 180 further includes an inner thermal foil duct hose 186 with a fiberglass insulation layer 188 that is slidably capable of exposing said inner thermal foil duct hose 186 for installation.

The seawater cooling system 194 includes a thru-hull inlet 196 mounted to the hull of a watercraft 198 for taking in fresh seawater and is configured to be under the waterline 200 relative to said watercraft 198. Seawater enters the seawater cooling system 194 at the thru-hull inlet 196. The seawater moves through a marine-grade hose 208 connecting the thru-hull inlet 196 to the strainer 204. From there, the strainer 204 filters out particulates from the seawater. A pump 202 is also included for pulling in fresh seawater through the seawater cooling system 194. Seawater flows through a marine-grade hose 210 connecting the strainer 204 to the pump 202. From the pump 202, the seawater passes through a marine-grade hose 212 connecting the pump 202 to the coil inflow 164 on the marine air conditioning unit 100.

Upon exiting through the coil outflow 162 on the marine air conditioning unit 100, a coil outflow 162 hose 214 connects the coil outflow 162 of the marine air conditioning unit 100 to an overboard seawater discharge 216, wherein the overboard seawater discharge 216 is configured to be above the waterline 200.

Upon exiting through the coil outflow 162 on the marine air conditioning unit 100, a coil outflow hose 214 connects the coil outflow 162 of the marine air conditioning unit 100 to an overboard seawater discharge 216, wherein the overboard seawater discharge 216 is configured to be above the waterline 200.

A shut-off valve 218 is located proximal to the thru-hull inlet 196 as a manual disconnect between the thru-hull inlet 196 and the seawater cooling system 194.

Further provided in the system is at least one condensate drain 140. The at least one condensate drain 140 allows the base drain pan 136 to empty. Hose barbs 222 are included to be installed at each drain hole 220 in the base 134 base drain pan 136. FIG. 23 is an exploded view of a condensate drain 140 and drain hose components. A threaded male end 221 of each hose barb 222 engages with a complementally threaded female aperture 234 in the drain hole 220. A marine-grade hose 228 is included, wherein said marine-grade hose 228 is snugly-fitted over the barbed end 226 of said hose barb 222. To secure the drain hose 228 to the hose barb 222, a stainless-steel hose clamp 230 is fitted to provide a secure connection between the hose 228 and the hose barb 222. The hose should drain from a collection point 232 wherein condensate may drain. Any condensate drains should not terminate within three feet of any outlet, engine, or generator exhaust system, nor in a compartment housing an engine or generator, nor in a bilge, unless the condensate drain is connected property to a sealed condensate or shower sump pump.

While included with the marine air-conditioning unit 100, it is important that the system include an air conditioning unit electrical box 170 providing power and control signals to said marine air conditioning system. The electrical box 170 should also include a fire-retardant cover 172. A universal control board 174 is provided within the air conditioning unit electrical box 170. This universal control board 174 includes universal connection terminals 176, which allow a system control display unit 236 connected to the universal control board 174 to operate the system as desired per the operation configuration input by a user. Also included is a power and control source connection incorporated within a single plug 264, which allows an easy do-it-yourself installation of the unit without the need for a professional.

In a standard configuration, the marine air conditioning unit 100 is connected to a seawater cooling system 194, wherein the seawater cooling system brings water from the thru-hull inlet 196, past the seacock 250, through marine-grade hoses and piping 206, to the strainer 204 wherein particles can be filtered out. The water then goes from the strainer 204 to the pump 202 and into the condenser coil 160. The water is then pushed out of an overboard seawater discharge 216. The system also includes the air-circulating configuration, wherein air is pulled from the cabin of the watercraft through the air return 190, through the marine air conditioning unit 100 where it is chilled, then through the insulated duct 184, wherein the chilled air will flow out of the air supply 180. An electrical box 170 is connected to the marine air conditioning unit, to provide power and control. In the electrical box 170 is the universal control board 174 with universal connection terminals 176 that allows for the installation of third-party controllers. In a preferred embodiment, the connection will also be included as a universal plug, so that the system can be easily connected and disconnected by a do-it-yourself user, wherein all the connections needed to connect and power the system are all contained in one single plug terminal.

Because this invention is configured for do-it-yourself installations, a method for installing a pre-charged and pre-wired marine air conditioning system is included.

The steps include providing a marine air conditioning system for easy connections, as described above. Next, the user begins installing vibration absorbing adhesive tape 154 on the base 134 of said marine air conditioner 100 to dampen vibrations, if vibration absorbing adhesive tape 154 is not already installed. FIG. 19 is a bottom view of the base of the marine air conditioning unit with vibration absorbing adhesive tape 154.

A user should take into consideration several layout factors when mounting the marine air-conditioning unit 100. This may include mounting the marine air conditioner unit 100 of the marine air conditioning system away from grill for the air return 192 to minimize sound level in a cabin 252 of the watercraft if possible. Also if possible, the user should be mounting the marine air conditioning unit 100 of the marine air conditioning system with the condenser 160 and evaporator 114 directly behind the grill for the air return 192 if adjacent to a bulkhead or other obstruction, or, mounting the marine air conditioning unit 100 of the marine air conditioning system with the condenser 160 and evaporator 114 with at least three inches of air circulation clearance if adjacent to a bulkhead or other obstruction and the marine air conditioning unit 100 cannot be mounted directly behind the grill for the air return 192. It is important that the installer is mounting the marine air conditioner 100 in a location that is sealed from direct access to bilge and engine room vapors. FIG. 20A is a view of a mounting location behind a bulkhead 260 of the marine air conditioning unit 100 with evaporator 114 parallel to an air return 190. FIG. 20B is a view of a mounting location of the marine air conditioning unit 100 with evaporator 114 perpendicular to an air return 190.

The marine air-conditioner unit 100 should be mounted to a low flat surface. Some examples of acceptable locations include the bottom of a locker, under a bunk, under a dinette seat, or similarly configured locations. To ensure proper airflow in these locations, an installer should ensure that the location has a minimum clearance of three-inches in front of the evaporator, and minimum clearance of four-inches in front of the grill for the air return.

Once the marine air conditioner 100 is mounted, the installer proceeds with adjusting a rotational orientation of said blower assembly 102. If needed, by loosening the lock screw 132 from one of said lock screw apertures 304, swiveling said blower assembly 102, and tightening said lock screw 132 once said blower assembly 102 is adjusted to a desired position.

Upon finalizing the position and configuration of the marine air-conditioning unit 100, a user then proceeds by installing a plurality of mounting brackets 137A to the base drain pan 136 of the marine air conditioner 100, wherein the mounting brackets 137A hook around a lip-wall 139 surrounding said base drain pan 136, wherein a screw 137B secures the mounting bracket 137A through an aperture 137C in a bottom portion of said mounting bracket 137A to a flat level mounting surface 141. In an ideal installation, this includes mounting four mounting brackets 137A, equally spaced, one at a front point of said base drain pan 136, one at a back point of said base drain pan 136, one at left point of said base drain pan 136, and one at a right point of said base drain pan 136. This will provide stability and securement at each side, especially when the boat is not on calm water. FIG. 21A is an enlarged perspective view of a base drain pan mounting bracket 137A. FIG. 21B is a left side view of the marine air conditioning system, showing the location of mounting brackets 137A.

With the marine air-conditioner 100 mounted, an installer can then place and tighten a set of hose barbs 222 in each drain hole 220 in the base drain pan 136, wherein a threaded male end 221 of each hose barb 222 engages with a complimental threaded female aperture 234. When these hose barbs 222 are installed, the user can begin fitting a marine grade drain hose 228 over the barbed end 226 of the hose barbs 222, and fastening a stainless steel hose clamp 230 to provide a secure connection between the drain hose 228 and the hose barb 222. The drain hoses 228 will need to be routed from a collection point 232. Condensate drains should not terminate within three feet of any outlet, engine, or generator exhaust system, nor in a compartment housing an engine or generator, nor in a bilge, unless the condensate drain is connected property to a sealed condensate or shower sump pump.

An installer can connect the marine air conditioner 100 to the marine air conditioning system by connecting the marine air conditioner 100 to an insulated duct 184 by sliding back the fiberglass insulation layer 188 on the insulated duct 184 to reveal the inner thermal foil duct hose 186. FIG. 22A is a side view of an insulated duct 184 aligning up with a duct mounting ring 168. FIG. 22B is a side view of an insulated duct 184 engaging with a duct mounting ring 168. The installer may then proceed by screwing at least three stainless steel screws 238 through the thermal foil duct hose 186 into the duct mounting ring 168, making sure internal structural wires 240 of said thermal foil duct hose 186 are secured by said screws 238 to securely fasten said thermal foil duct hose 186 to said duct mounting ring 186. FIG. 22C is a side view of an engaged insulated duct 184 and duct mounting ring 168 with securement screws 238. Once the thermal foil duct hose 186 is mounted to the duct mounting ring 186, an installer can slide the fiberglass insulation layer 188 back over the inner thermal foil duct hose 186, thereby covering the thermal foil duct hose 186. The installer should then seal the fiberglass insulation layer 188 on said insulated duct 184 to the duct mounting ring 168 with a condensation inhibiting tape 258. This tape 258 is ideally aluminum foil tape. FIG. 22D is a side view of an engaged insulated duct 184 and duct mounting ring 168 sealed with condensation inhibiting tape 258.

An installer can connect an outflow 242 of the pump 202 to the coil inflow 164 on the marine air conditioner 100 with a marine-grade hose 212, wherein the marine-grade hose 212 is a reinforced marine-grade hose. This will allow the seawater cooling system 194 to help cool the marine air conditioner 100. To make sure the water is able to drain, an installer will connect the coil outflow 162 on the marine air conditioner 100 to an overboard seawater discharge 216 with a marine-grade hose 214.

The system operates using a universal control board. This allows the marine air conditioner 100 to work with control equipment, which is especially valuable when using this marine air-conditioning unit 100 as a replacement. An installer will connect the marine air-conditioning unit 100 to a universal control board 174 configured to work with third-party thermostat systems. Using a single plug 264 connection for ease of do-it-yourself installation by non-professionals allows the non-professional to easily install the unit with minimal complication. The installer will then connect a thermostat system with control display 236 to the universal connection terminal 176 in said electrical box 170.

While the marine air-conditioning unit 100 is a practical solution for replacement situations, it is also a good solution for new installs as well. If not already included in the watercraft, or if the watercraft is under construction, an installer may also place a thru-hull fitting 196 away from a waterline 200, wherein slots (not shown, but may be appreciated from the thru-hull fitting 196 as shown in FIGS. 17 and 18, wherein it should be understood that the thru-hull inlet includes an opening, as is typical in the art, but the opening will be directed toward the forward direction of the watercraft) of the thru-hull fitting 196 are directed towards the bow of said watercraft to obtain positive pressure in the suction line 246. This step is included if a thru-hull fitting 196 does not exist in the watercraft for the air conditioning equipment, or if a thru-hull fitting 196 in general is not already installed in the watercraft. An installer may place a bronze seacock 250 on the thru-hull fitting, if a seacock 250 does not exist in the watercraft for air conditioning equipment. If a pump does not exist in the watercraft for air conditioning equipment, the installer may install a pump 202 at a level of at least 30 inches below the waterline 200, except when a self-priming pump is used. The installer may install a strainer 204 below the level of the pump 202, if a strainer does not exist in the watercraft for air conditioning equipment. The installer may connect the seacock 250 and strainer 204 with a reinforced marine-grade hose 208 if a seacock and strainer are not installed in the watercraft. The installer may connect the strainer 204 and the pump 202 with a reinforced marine-grade hose 210 if a strainer and a pump are not already installed in the watercraft.

While the marine air-conditioning unit 100 is a practical solution for replacement situations, it is also a good solution for new installs as well. If not already included in the watercraft, or if the watercraft is under construction, an installer may also place a thru-hull fitting 196 away from a waterline 200, wherein slots (not shown, but may be appreciated from the thru-hull fitting 196 as shown in FIGS. 17 and 18, wherein it should be understood that the thru-hull inlet includes an opening, as is typical in the art, but the opening will be directed toward the forward direction of the watercraft) of the thru-hull fitting 196 are directed towards the bow of said watercraft to obtain positive pressure in the suction line 246. This step is included if a thru-hull fitting 196 does not exist in the watercraft for the air conditioning equipment, or if a thru-hull fitting 196 in general is not already installed in the watercraft. An installer may place a bronze seacock 250 on the thru-hull fitting, if a seacock 250 does not exist in the watercraft for air conditioning equipment. If a pump does not exist in the watercraft for air conditioning equipment, the installer may install a pump 202 at a level of at least 30 inches below the waterline 200, except when a self-priming pump is used. The installer may install a strainer 204 below the level of the pump 202, if a strainer does not exist in the watercraft for air conditioning equipment. The installer may connect the seacock 250 and strainer 204 with a reinforced marine-grade hose 208 if a seacock and strainer are not installed in the watercraft. The installer may connect the strainer 204 and the pump 202 with a reinforced marine-grade hose 210 if a strainer and a pump are not already installed in the watercraft.

In an exemplary embodiment of the invention, an air conditioning unit is provided having a main body having at least an evaporator with an evaporator cover 261. The evaporator cover 261 has an aperture 120A, whereby the aperture 120A is bordered on a side 268 opposite of the evaporator 114 by a plurality of frustum-spherical wall sections 266, thereby creating a boundary, as may be seen in the FIGS. 4-8. A frustum-spherical gyro-swivel ring 278 is positioned within the boundary of said frustum-spherical wall sections 266, whereby the frustum-spherical gyro-swivel ring 278 is configured to complement dimensions of an interior surface boundary 270 of said plurality of frustum-spherical wall sections 266. Namely, the dimension of the inner gyro-swivel ring is configured to nest within the outer boundary. A fitment ring 263 is removably affixed to a protruding lip 274 of the frustum-spherical gyro-swivel ring 278, whereby the fitment ring 263 couples the frustum-spherical gyro-swivel ring 278 to a blower assembly, a combination of which may be appreciated in FIGS. 5-8.

In some embodiments of the air conditioning unit 100, the frustum-spherical wall sections 266 movably contain the frustum-spherical gyro-swivel ring 278 in a tight periphery, thereby allowing the frustum-spherical gyro-swivel ring 278 to adjust in orientation, whereby the adjustment in orientation influences a direction of airflow in a conical range of orientations to a blower, whereby the blower may expel air in a plurality of selectable directions in a range of angulation resembling a dual conical shape, as may be seen in FIG. 10. FIG. 10 includes the range of swivel 291, as it relates to the blower 102. FIG. 11 includes the various ranges of rotatability, including inward rotational of the directional airflow 296, the outward rotational of the directional airflow 292, a forward flow of the airflow 298, the 360-degree rotation 294 of the blower in relation to the evaporator, and the range of inward to outward motion 300, of the directional airflow.

In some embodiments of the air conditioning unit 100, the system further includes at least one locking screw 132 wherein a stem of the at least one locking screw 132 is configured to pass through an opening 302 between a pair of frustum-spherical wall sections 266 of the plurality of the frustum-spherical wall sections 266 and engage at least one aperture 304 in the frustum-spherical gyro-swivel ring 278. The stem of the screw includes portions typically known as the thread and the shank in the art. Once tightened, a head of a locking screw 132 presses at least one frustum-spherical wall section 266 of the plurality of the frustum-spherical wall sections 266 against a body of the frustum-spherical gyro-swivel ring 278, thereby creating a tight couple between the at least one frustum-spherical wall section 266 and the body of the frustum-spherical gyro-swivel ring 278.

In addition to the swivel gyro-mount technology disclosed in this invention, the invention is incorporable into air conditioning systems, and in particular, may be used in marine self-contained air conditioning systems, as well as similar devices. This system may also be incorporated into my other disclosed invention, a self-contained marine air conditioning unit, air conditioning system, and method of installation disclosed in my co-pending application, U.S. Pub. No.: 2022/0126973, filed Feb. 12, 2021, which claims priority to my provisional application, No. 63/104,189, filed Oct. 22, 2020, the contents of which are incorporated herein by reference.

While there has been shown and described above the preferred embodiment of the instant invention it is to be appreciated that the invention may be embodied otherwise than is herein specifically shown and described and that certain changes may be made in the form and arrangement of the parts without departing from the underlying ideas or principles of this invention as set forth in the Claims appended herewith.

I claim:

1. A marine air conditioning unit, comprising:

a main body having at least an evaporator with an evaporator cover;

the evaporator cover having an aperture, whereby said aperture is bordered on a side opposite of said evaporator by a plurality of frustum-spherical wall sections, thereby creating a boundary;

a frustum-spherical swivel gyro ring positioned within the boundary of said frustum-spherical wall sections, whereby said frustum-spherical swivel gyro ring is configured to complement dimensions of an interior surface boundary of said plurality of frustum-spherical wall sections; and a fitment ring removably affixed to a protruding lip of said frustum-spherical swivel gyro ring, whereby said fitment ring rotatably couples said frustum-spherical swivel gyro ring to a blower assembly.

2. The air conditioning unit, as recited in claim 1, further comprising:

at least one locking screw, wherein a stem of said at least one locking screw is configured to pass through an opening between a pair of frustum-spherical wall sections of said plurality of said frustum-spherical wall sections and engage at least one aperture in said frustum-spherical swivel gyro ring, whereby once tightened, a head of said at least one locking screw presses at least one frustum-spherical wall section of said plurality of said frustum-spherical wall sections against a body of said frustum-spherical swivel gyro ring, thereby creating a right couple between said at least one frustum-spherical wall section and said body of said frustum-spherical swivel gyro ring.

3. The air conditioning unit, as recited in claim 1, wherein said frustum-spherical wall sections movably contain said frustum-spherical swivel gyro ring in a tight periphery, thereby allowing said frustum-spherical swivel gyro ring to adjust in orientation, whereby said adjustment in orientation influences a direction of airflow in a conical range of orientations to a blower, whereby said blower may expel air in a plurality of selectable directions in a range of angulation resembling a dual conical shape.

4. A self-contained marine air conditioning system, comprising:

a seawater cooling circuit, a refrigerant circuit, and a blower assembly;

said refrigerant circuit includes a reverse valve connecting a compressor, an evaporator, and a refrigerant tube thermally engaged with a condenser coil;

said seawater cooling circuit includes said condenser coil;

said condenser coil having a condenser coil outflow and a condenser coil inflow;

said blower assembly is mounted in communication with said evaporator, wherein said blower assembly may pull air through said evaporator;

an evaporator cover having an aperture, whereby said aperture is bordered on a side opposite of said evaporator by a plurality of frustum-spherical wall sections, thereby creating a boundary;

a frustum-spherical swivel gyro ring positioned within the boundary of said frustum-spherical wall sections, whereby said frustum-spherical swivel gyro ring is configured to complement dimensions of an interior surface boundary of said plurality of frustum-spherical wall sections; and a fitment ring removably affixed to a protruding lip of said frustum-spherical swivel gyro ring, whereby said fitment ring couples said frustum-spherical swivel gyro ring to said blower assembly.

5. The air conditioning unit, as recited in claim 4, further comprising:

at least one locking screw, wherein a stem of said at least one locking screw is configured to pass through an opening between a pair of frustum-spherical wall sections of said plurality of said frustum-spherical wall sections and engage at least one aperture in said frustum-spherical swivel gyro ring, whereby once tightened, a head of said at least one locking screw presses at least one frustum-spherical wall section of said plurality of said frustum-spherical wall sections against a body of said frustum-spherical swivel gyro ring, thereby creating a right couple between said at least one frustum-spherical wall section and said body of said frustum-spherical swivel gyro ring.

6. The marine air conditioning unit recited in claim 4, wherein said frustum-spherical wall sections movably contain said frustum-spherical swivel gyro ring in a tight periphery, thereby allowing said frustum-spherical swivel gyro ring to adjust in orientation, whereby said adjustment in orientation influences a direction of airflow in a conical range of orientations to a blower, whereby said blower may expel air in a plurality of selectable directions in a range of angulation resembling a dual conical shape.

7. The marine air conditioning unit recited in claim 4, wherein the condenser coil, the condenser coil outflow, and the condenser coil inflow are constructed of anti-corrosive titanium.

8. The marine air conditioning unit recited in claim 4, further comprising:

an electrical box with fire retardant cover;

a universal control board with universal connection terminals; and a power and control source connection incorporated within a single plug.

9. The marine air conditioning unit recited in claim 4, further comprising:

a base having a base drain pan, at least one condensate drain, and at least two handles;

said base is a stainless-steel frame base;

said base drain pan, wherein said base drain pan is molded from a unitary piece of material;

said handles formed with the material of the base drain pan and are configured to be located near heaviest points of the marine air conditioning unit to provide a stable point for a user to pick up said marine air conditioning unit, wherein one handle is located proximal to said evaporator and a second handle is located proximal to a dryer; and sound and vibration dampening elements, wherein said vibration dampening elements include at least one of an adhesive foam affixed to an outer surface of said blower assembly, and vibration absorbing adhesive tape configured to be affixed to an underside of said base drain pan.

10. The marine air conditioning unit recited in claim 4, further comprising:

an air filter attached to said evaporator.

11. The marine air conditioning unit recited in claim 4, further comprising:

a high-pressure switch.

12. A marine air conditioning system, comprising a marine air conditioner having:

a seawater cooling circuit and a refrigerant circuit and a blower assembly;

said refrigerant circuit includes a reverse valve connecting a compressor, an evaporator, and a refrigerant tube thermally engaged with a condenser coil;

said seawater cooling circuit includes said condenser coil, having a condenser coil outflow and a condenser coil inflow;

said blower assembly is mounted in communication with said evaporator, wherein said blower assembly may pull air through said evaporator;

an evaporator cover having an aperture, whereby said aperture is bordered on a side opposite of said evaporator by a plurality of frustum-spherical wall sections, thereby creating a boundary;

a frustum-spherical swivel gyro ring positioned within the boundary of said frustum-spherical wall sections, whereby said frustum-spherical swivel gyro ring is configured to complement dimensions of an interior surface boundary of said plurality of frustum-spherical wall sections;

a fitment ring removably affixed to a protruding lip of said frustum-spherical swivel gyro ring, whereby said fitment ring couples said frustum-spherical swivel gyro ring to said blower assembly;

a base having a base drain pan, at least one condensate drain, and at least two handles;

said base is a stainless-steel frame base;

said base drain pan, wherein said base drain pan is molded from a unitary piece of material;

said handles formed with the material of the base drain pan and are configured to be located near the heaviest points of the marine air conditioning unit to provide a stable point for a user to pick up said marine air conditioning unit, wherein one handle is located proximal to said evaporator and a second handle is located proximal to a dryer;

sound and vibration dampening elements, wherein said vibration dampening elements include at least one of an adhesive foam affixed to an outer surface of said blower assembly, and vibration absorbing adhesive tape configured to be affixed to an underside of said base drain pan;

and a high-pressure switch;

an air supply;

an insulated duct connecting said blower assembly to said air supply;

an air return located in close proximity to the evaporator of the marine air conditioning unit;

a duct mounting ring engaged with an opening of said blower assembly;

a seawater cooling system connected to said seawater circuit of said marine air conditioner;

at least one condensate drain;

an air conditioning unit electrical box providing power and control signals to said marine air conditioning system, wherein said electrical box includes a fire-retardant cover;

a universal control board within said air conditioning unit electrical box;

a power and control source connection incorporated within a single plug; and a system control display unit connected to said universal control board in said air conditioning unit electrical box.

13. The marine air conditioning system as recited in claim 12, wherein the condenser coil, the condenser coil outflow, and the condenser coil inflow are constructed of anti-corrosive titanium.

14. The marine air conditioning system as recited in claim 12, wherein said air supply further includes a grill for said air supply.

15. The marine air conditioning system as recited in claim 12, wherein said air return further includes a grill for said air return.

16. The marine air conditioning system as recited in claim 12, wherein said seawater cooling system further comprises:

a thru-hull inlet mounted to a hull of a watercraft for taking in fresh seawater and configured to be under a waterline relative to said watercraft;

a pump for pulling in fresh seawater;

a strainer to filter out particulates;

a marine-grade hose connecting said thru-hull inlet to said strainer;

a marine-grade hose connecting said strainer to said pump;

a condenser coil inflow connecting said pump to said condenser coil inflow on said marine air conditioning unit;

a condenser coil outflow connecting said condenser coil outflow of said marine air conditioning unit to an overboard seawater discharge, wherein said overboard seawater discharge is configured to be above the waterline; and a shut-off valve located proximal to said thru-hull inlet as a manual disconnect between said thru-hull inlet and said seawater cooling system.

17. The marine air conditioning system as recited in claim 12, wherein the insulated duct connecting said blower assembly to said air supply further comprises an inner thermal foil duct hose with a fiberglass insulation layer that is slidably capable of exposing said inner thermal foil duct for installation.

18. The marine air conditioning system as recited in claim 12, wherein the at least one condensate drain further includes:

a hose barb installed in each drain hole in said base drain pan, wherein a threaded male end of each hose barb engages with a complementally threaded female aperture, a marine grade hose, wherein said marine-grade hose is snugly-fitted over the barbed end of said hose barb;

a stainless-steel hose clamp fitted to provide a secure connection between said hose and said hose barb; and a collection point wherein condensate may drain.

19. A method for installing a pre-charged and pre-wired marine air conditioning system, comprising providing a marine air conditioning system, including:

a marine air conditioner, having:

a seawater cooling circuit and a refrigerant circuit and a blower assembly;

said refrigerant circuit includes a reverse valve connecting a compressor, an evaporator, and a refrigerant tube thermally engaged with a titanium condenser coil;

said seawater cooling circuit includes said titanium condenser coil, having a titanium condenser coil outflow and a titanium condenser coil inflow;

said blower assembly is mounted in communication with said evaporator, wherein said blower assembly may pull air through said evaporator;

an evaporator cover having an aperture, whereby said aperture is bordered on a side opposite of said evaporator by a plurality of frustum-spherical wall sections, thereby creating a boundary;

a frustum-spherical swivel gyro ring positioned within the boundary of said frustum-spherical wall sections, whereby said frustum-spherical swivel gyro ring is configured to complement dimensions of an interior surface boundary of said plurality of frustum-spherical wall sections;

a fitment ring removably affixed to a protruding lip of said frustum-spherical swivel gyro ring, whereby said fitment ring couples said frustum-spherical swivel gyro ring to said blower assembly;

a base having a base drain pan, at least one condensate drain, and at least two handles;

said base is a stainless-steel frame base;

said base drain pan, wherein said base drain pan is molded from a unitary piece of material;

said handles formed with the material of the base drain pan and are configured to be located near the heaviest points of the marine air conditioning unit to provide a stable point for a user to pick up said marine air conditioning unit, wherein one handle is located proximal to said evaporator and a second handle is located proximal to a dryer;

sound and vibration dampening elements, wherein said vibration dampening elements include at least one of an adhesive foam affixed to an outer surface of said blower assembly, and vibration absorbing adhesive tape configured to be affixed to an underside of said base drain pan;

and a high-pressure switch;

an air supply;

a grill for said air supply;

an insulated duct connecting said blower assembly to said air supply, wherein said insulated duct is defined as an inner thermal foil duct hose with a fiberglass insulation layer that is slidably capable of exposing said inner thermal foil duct for installation;

an air return located in close proximity to the evaporator of the marine air conditioning unit;

a grill for said air return;

a seawater cooling system, including:

a thru-hull inlet mounted to a hull of a watercraft for taking in fresh seawater and configured to be under a waterline relative to said watercraft;

a pump for pulling in fresh seawater;

a strainer to filter out particulates;

a marine-grade hose connecting said thru-hull inlet to said strainer;

a marine-grade hose connecting said strainer to said pump;

a condenser coil inflow connecting said pump to said titanium condenser coil inflow on said marine air conditioning unit;

a condenser coil outflow connecting said titanium condenser coil outflow of said marine air conditioning unit to an overboard seawater discharge, wherein said overboard seawater discharge is configured to be above the waterline; and a shut-off valve located proximal to said thru-hull inlet as a manual disconnect between said thru-hull inlet and said seawater cooling system;

at least one condensate drain;

said at least one condensate drain further includes:

a hose barb installed in each drain hole in said base drain pan, wherein a threaded male end of each hose barb engages with a complemental threaded female aperture, a marine grade hose, wherein said marine-grade hose is snugly-fitted over the barbed end of said hose barb;

a stainless-steel hose clamp fitted to provide a secure connection between said hose and said hose barb; and a collection point wherein condensate may drain;

an air conditioning unit electrical box providing power and control signals to said marine air conditioning system, wherein said electrical box includes a fire-retardant cover;

a universal control board within said air conditioning unit electrical box;

a power and control source connection incorporated within a single plug; and a system control display unit connected to said universal control board in said air conditioning unit electrical box;

installing vibration absorbing adhesive tape on the base of said marine air conditioner to dampen vibrations, if vibration absorbing adhesive take tape is not already installed;

mounting the marine air conditioner of said marine air conditioning system away from said grill for said air return to minimize sound level in a cabin of the watercraft if possible;

mounting the marine air conditioner of said marine air conditioning system with said condenser and evaporator directly behind said grill for said air return if adjacent to a bulkhead or other obstruction;

mounting the marine air conditioner of said marine air conditioning system with said titanium condenser coil and said evaporator having at least three inches of air circulation clearance if adjacent to a bulkhead or other obstruction, and said marine air conditioner cannot be mounted directly behind said grill for said air return;

adjusting a rotational orientation of said blower assembly, if needed, by loosening the lock screw from one of said lock screw apertures, swiveling said blower assembly, and tightening said lock screw once said blower assembly is adjusted to a desired position;

installing a plurality of mounting brackets to said base drain pan of said marine air conditioner, wherein said mounting brackets hook around a lip-wall surrounding said base drain pan, wherein a screw secures the mounting bracket through an aperture in a bottom portion of said mounting bracket to a flat level mounting surface;

placing and tightening a set of hose barbs in each drain hole in said base drain pan, wherein a threaded male end of each hose barb engages with a complemental threaded female aperture;

fitting a marine grade drain hose is over the barbed end of said hose barbs;

fastening a stainless-steel hose clamp is to provide a secure connection between said drain hose and said hose barb;

routing said drain hose from a collection point;

connecting said marine air conditioner to said insulated duct by sliding back the fiberglass insulation layer on said insulated duct to reveal the inner thermal foil duct hose;

screwing at least three stainless steel screws through the thermal foil duct hose into a duct mounting ring, making sure wires of said thermal foil duct hose are secured by said screws to securely fasten said thermal foil duct hose to said duct mounting ring;

sliding said fiberglass insulation layer back over said inner thermal foil duct hose, thereby covering said thermal foil duct hose;

sealing said fiberglass insulation layer to said duct mounting ring with a condensation inhibiting tape;

connecting an outflow of said pump to the titanium condenser coil inflow on said marine air conditioner with a reinforced marine-grade hose;

connecting a discharge from the titanium condenser coil outflow on the marine air conditioner to a seawater outlet with a marine-grade hose;

connecting the marine air conditioner to a universal control board configured to work with third-party thermostat systems;

connecting a thermostat system with control display to a universal connection terminal in said electrical box; and connecting said thermostat system and connecting an electrical source by using a single all-inclusive plug.

20. The method for installing a pre-charged and pre-wired marine air conditioning system, as recited in claim 19, further comprising:

placing a thru-hull fitting away from a waterline water line, wherein slots of said thru-hull fitting are directed towards the bow of said watercraft, if the thru-hull fitting does not exist in the watercraft for air conditioning equipment, or if the thru-hull fitting is not already installed in the watercraft;

placing a bronze seacock on the thru-hull fitting, if the seacock does not exist in the watercraft for air conditioning equipment;

unless a self-priming pump is used, installing a pump at a level of at least 30 inches below the waterline, if the pump does not exist in the watercraft for air conditioning equipment;

installing said strainer below the level of the pump, if said strainer does not exist in the watercraft for air conditioning equipment;

connecting the seacock and strainer with a reinforced marine-grade hose if a seacock and strainer are not installed in the watercraft; and connecting said strainer and said pump with a reinforced marine-grade hose if said strainer and a pump are not installed in the watercraft.

21. The method for installing a pre-charged and pre-wired marine air conditioning system, as recited in claim 19, wherein the mounting of the marine air conditioner of said marine air conditioning system further includes mounting said marine air conditioner in a location that is sealed from direct access to bilge and engine room vapors.

22. The method for installing a pre-charged and pre-wired marine air conditioning system, as recited in claim 19, wherein said tape in said sealing of said fiberglass insulation layer to said duct mounting ring with the condensation inhibiting tape is an aluminum foil tape.

23. The method for installing a pre-charged and pre-wired marine air conditioning system, as recited in claim 19, wherein the installing of the plurality of mounting brackets to said base drain pan of said marine air conditioner further includes mounting four mounting brackets, equally spaced, one at a front point of said base drain pan, one at a back point of said base drain pan, one at left point of said base drain pan, and one at a right point of said base drain pan.

* * * * *